US008666280B2

(12) United States Patent
Mizuno et al.

(10) Patent No.: US 8,666,280 B2
(45) **Date of Patent: *Mar. 4, 2014**

(54) IMAGE FORMING APPARATUS

(75) Inventors: Tatsubumi Mizuno, Numazu (JP); Kazufumi Muto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/546,332

(22) Filed: Jul. 11, 2012

(65) Prior Publication Data

US 2012/0275823 A1 Nov. 1, 2012

Related U.S. Application Data

(62) Division of application No. 12/118,198, filed on May 9, 2008, now Pat. No. 8,254,805.

(30) Foreign Application Priority Data

May 15, 2007 (JP) ..... 2007-129252
Mar. 25, 2008 (JP) ..... 2008-077497

(51) Int. Cl.
*G03G 21/16* (2006.01)

(52) U.S. Cl.
USPC ..... 399/111; 399/113; 399/114

(58) Field of Classification Search
USPC ..... 399/110–114
See application file for complete search history.

(56) References Cited

U.S. PATENT DOCUMENTS 5,608,498 A 3/1997 Nagase et al.
6,157,792 A 12/2000 Mori et al.
6,404,996 B1 6/2002 Mori et al.
6,912,365 B2 6/2005 Ueno et al.
7,024,133 B2 4/2006 Nagashima et al.
7,447,467 B2 11/2008 Kamimura et al.

(Continued)

FOREIGN PATENT DOCUMENTS

JP 8-220824 8/1996
JP 2001-272864 10/2001

(Continued)

OTHER PUBLICATIONS

Chinese Office Action issued in Chinese Patent Application No. 200810099244.4, dated Aug. 21, 2009 (with an English translation).

*Primary Examiner* — David Gray
*Assistant Examiner* — Carla Therrien
(74) *Attorney, Agent, or Firm* — Fitzpatrick, Cella, Harper & Scinto

(57) ABSTRACT

An image forming apparatus forms an image on a recording material, and detachably mounts process cartridges having photosensitive drums. The apparatus includes a main assembly, a rotatable openable member, a belt receiving an image or carrying the recording material, supporting members supporting the process cartridges at different levels and movable between drum-contacting and retracted positions, and a connecting member moving the supporting member when the openable members moves to position the supporting member at the drum-contacting position when the openable member is closed, and position the supporting member at the retracted position when the openable member is opened, and including a shaft whose axis crosses the openable member rotational axis, first connecting portions rotatably connected with respective supporting members, and a second connecting portion engaging the openable member and fixed to the shaft closer to the openable member than the first connecting portions are fixed to the shaft.

8 Claims, 18 Drawing Sheets

(56) References Cited

U.S. PATENT DOCUMENTS

| | | | |
|---|---|---|---|
| 7,486,907 | B2 | 2/2009 | Noguchi et al. |
| 7,509,071 | B2 | 3/2009 | Yoshimura et al. |
| 7,660,549 | B2 | 2/2010 | Noguchi et al. |
| 7,715,746 | B2 | 5/2010 | Tanabe et al. |
| 7,715,752 | B2 | 5/2010 | Sakurai et al. |
| 7,761,024 | B2 | 7/2010 | Imaizumi et al. |
| 7,773,911 | B2 | 8/2010 | Kawamura |
| 8,010,014 | B2 * | 8/2011 | Noguchi ..... 399/111 |
| 2006/0120758 | A1 | 6/2006 | Muto |

FOREIGN PATENT DOCUMENTS

| | | | |
|---|---|---|---|
| JP | 2003-162203 | 6/2003 | |
| JP | 2004-212986 | 7/2004 | |
| JP | 2012145879 A * | 8/2012 | ..... G03G 21/18 |

* cited by examiner

IMAGE FORMING APPARATUS

FIELD OF THE INVENTION AND RELATED ART

The present invention relates to an image forming apparatuses, such as a copying machine, a printer, and a facsimile machine. More particularly, it relates to the image forming apparatus of a type of mounting, demounting and exchanging a process cartridge provided inside a device, with opening and closing the cover of an outer casing.

In a known image forming apparatus, an image bearing member with which a toner image is formed, and image formation device are in the form of a process cartridge detachably mountable to a main assembly of the image forming apparatus, and, therefore, the operations of inspection and the exchanges of the image bearing member and the image formation device are easy.

In a color image forming apparatus which has a plurality of process cartridges disclosed in JP 2004-212986A, the width of the main assembly of the image forming apparatus with respect to the horizontal direction is decreased by arranging the process cartridges obliquely relative to the main assembly of the image forming apparatus.

In addition, in JP 8-220824A, for the easiness of the exchange of the process cartridge, a cartridge supporting member in the main assembly of the image forming apparatus is moved in interrelation with the opening and closing of the frame side cover of the image forming apparatus, and the process cartridge is moved between an image formation position and a removing position.

In addition, in JP 2003-162203A, a rotatable centering plate 59 for open and closing the loading slot of the process cartridge is provided inside a front door 58 rotatably provided in the apparatus main assembly.

Here, in the image forming apparatus in which a plurality of process cartridges are arranged obliquely, the case where it moves up and down the process cartridges between the image formation position and the removing position in interrelation with the opening and closing of the frame side cover is considered. If the rising and lowering direction of the process cartridge in interrelation with the opening and closing of the cover is made in the vertical direction with respect to the arranging direction of the process cartridges in this case, the downsizing and simplification of the device will be accomplished. More particularly, since the cartridge supporting members which support the process cartridges through one rotation shaft (supporting member connecting shaft) can simultaneously be moved with the minimum space, the downsizing and simplification of the device are accomplished.

However, in the prior art, The rising and lowering direction of the process cartridge is perpendicular to the rotation shaft of the cover, and therefore, in order to employ the supporting member connecting shaft perpendicular to the rising and lowering direction, it is required for the rotation shaft of the cover and supporting member connecting shaft to be parallel with each other. The rotation shaft of then and the cover must be obliquely provided relative to the main assembly of the image forming apparatus, and therefore, the operativity is poor. On the contrary, from the viewpoint of the operativity, it will be considered that the cover has the horizontal rotation shaft, and the rising and lowering direction of the process cartridge is perpendicular to this shaft (namely, the perpendicular direction). When it does so, then, the distances between the rotation shafts of the cover and the cartridge supporting members differ from each other, with the result that, the linkages become complicated and bulky, and therefore, the downsizing of the device will not be accomplished.

Therefore, only by combining the prior art simply, both of the improvement of the operativity and downsizing and simplification of device cannot be accomplished.

In the case of in addition, having the two doors in the device in JP 2003-162203A, at the time of mounting and demounting the process cartridge, the user needs to open and close the respective door.

SUMMARY OF THE INVENTION

It is a principal object of the present invention to provide an image forming apparatus which can accomplish the both of downsizing and simplification of the main assembly of the image forming apparatus and the improvement of the operativity with respect to the process cartridge exchange.

According to an aspect of the present invention, there is provided an image forming apparatus for forming an image on a recording material, to which apparatus a plurality of process cartridges each including a photosensitive drum and process means actable on said photosensitive drum is detachably mountable, said image forming apparatus comprising an openable member provided in a main assembly of the apparatus and rotatable about a rotational axis thereof, said openable member is movable between an opening position for opening an opening provided in the main assembly of the apparatus of said image forming apparatus and a closing position for closing said opening; a belt for receiving an image or carrying said recording material; a plurality of supporting members for supporting said process cartridges at different level positions, said supporting member being movable between a first position for contacting said photosensitive drum to said belt and a second position spacing said photosensitive drum from said belt; and a connecting member for moving said supporting member in interrelation with movement of said openable member, wherein said connecting member positions said supporting member at said first position when said openable member takes the closing position, and said connecting member positions said supporting member at said second position when said openable member takes the opening position, said connecting member including a shaft having an axis crossing with a rotational axis of said openable member, a plurality of first connecting portions rotatably connected with respective supporting members and fixed to said shaft, and a second connecting portion for engagement with said openable member and fixed to said shaft at a position which is closer to said openable member than said first connecting portions with respect to the crossing direction.

According to another aspect of the present invention, there is provided an image forming apparatus for forming an image on a recording material, to which apparatus a process cartridge including a photosensitive drum and process means actable on said photosensitive drum is detachably mountable, said image forming apparatus comprising an openable member provided in a main assembly of the apparatus and rotatable about a rotational axis thereof, said openable member is movable between an opening position for opening an opening provided in the main assembly of the apparatus of said image forming apparatus and a closing position for closing said opening; a belt for receiving an image or carrying said recording material; a supporting member for supporting said process cartridge, said supporting member being movable between a first position for contacting said photosensitive drum to said belt and a second position spacing said photosensitive drum from said belt;

a carrying member, provided rotatably in said main assembly of the apparatus, for moving in interrelation with movement of said openable member, said carrying member being capable of carrying said process cartridge when said process cartridge is mounted or demounted relative to said supporting member positioned at said second position in the state that openable member takes the opening position; and a connecting member, engaged with said carrying member and said supporting member, for moving said supporting member in interrelation with movement of said carrying member, wherein said connecting member positions said supporting member at the first position when said openable member takes the closing position, and said connecting member positions said supporting member at the second position when said openable member takes the opening position.

These and other Objects and features, and advantages of the present invention will become more apparent upon consideration of the following description of the preferred embodiments of the present invention, taken in conjunction with the accompanying drawings.

BRIEF DESCRIPTION OF DRAWINGS

In FIG. 15, (*b*) is a perspective view of a connecting member and a cartridge supporting member.

DETAILED DESCRIPTION OF THE PREFERRED EMBODIMENTS

Embodiment 1

<<General Arrangement of Image Forming Apparatus>>

Figure 1:
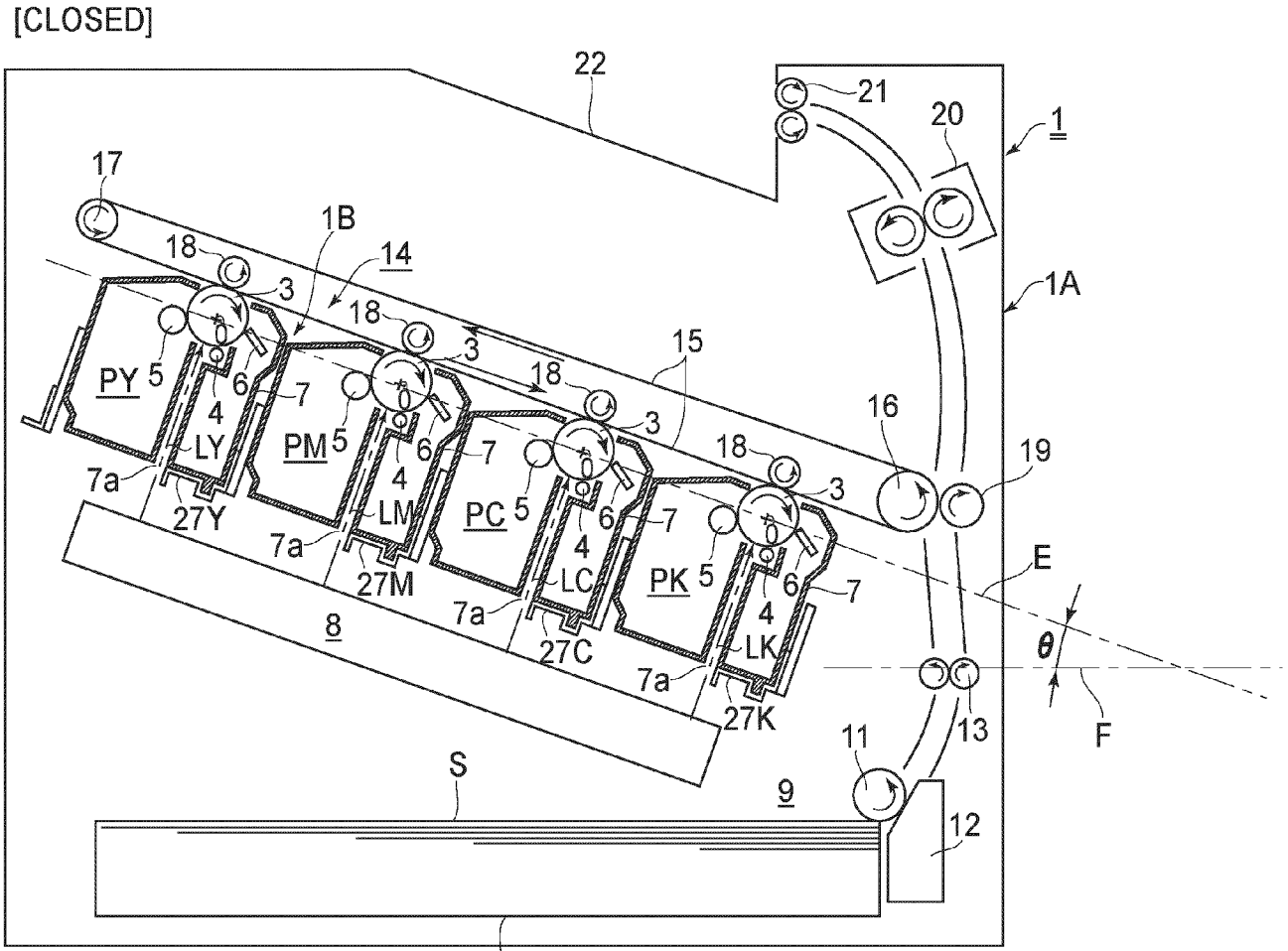
FIG. 1 is a schematic vertical section front view of an image forming apparatus of Embodiment 1.
Figure 2:
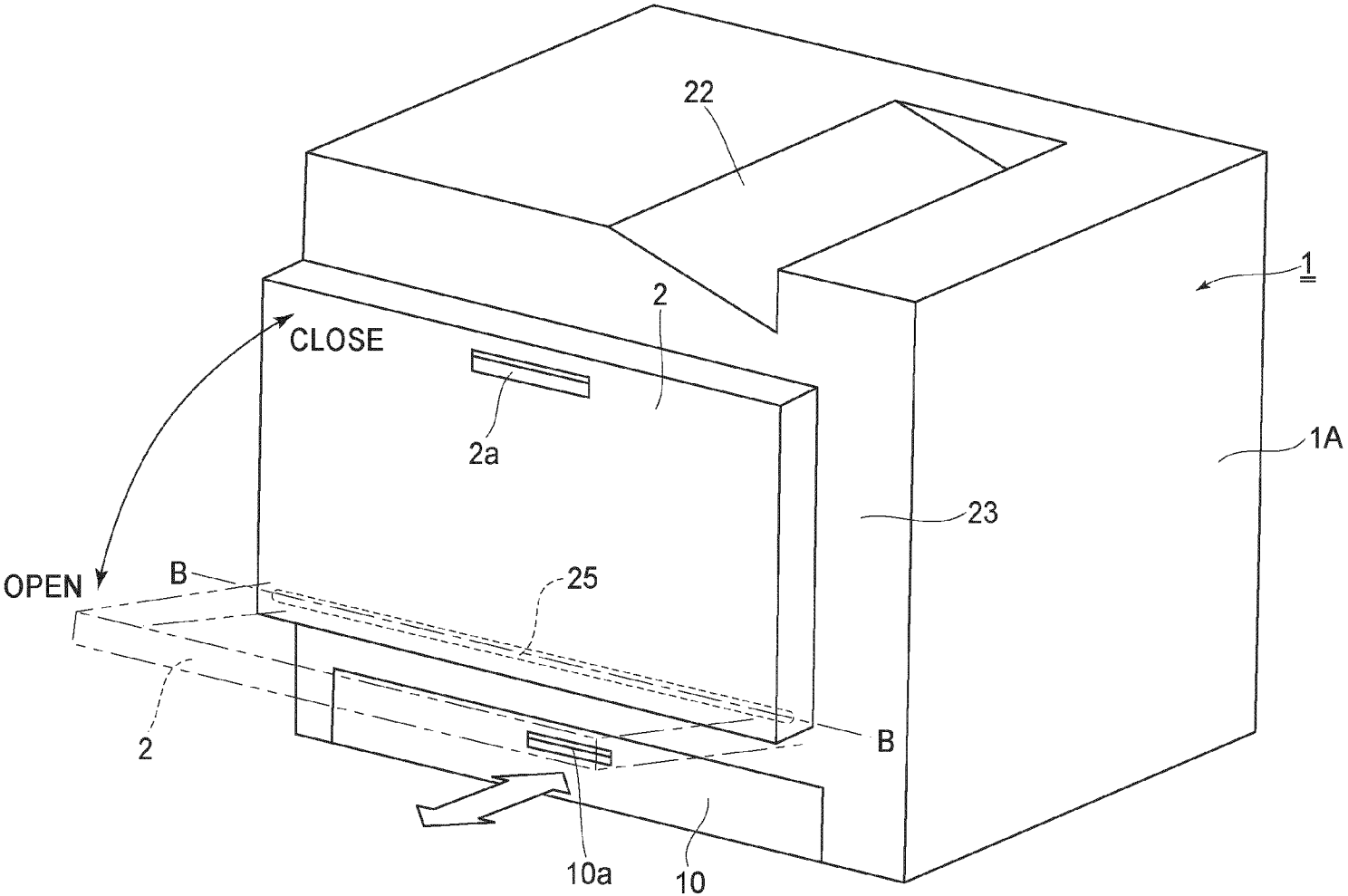
FIG. 2 is an outer appearance perspective view of the image forming apparatus in which the front door closes.
Figure 3:
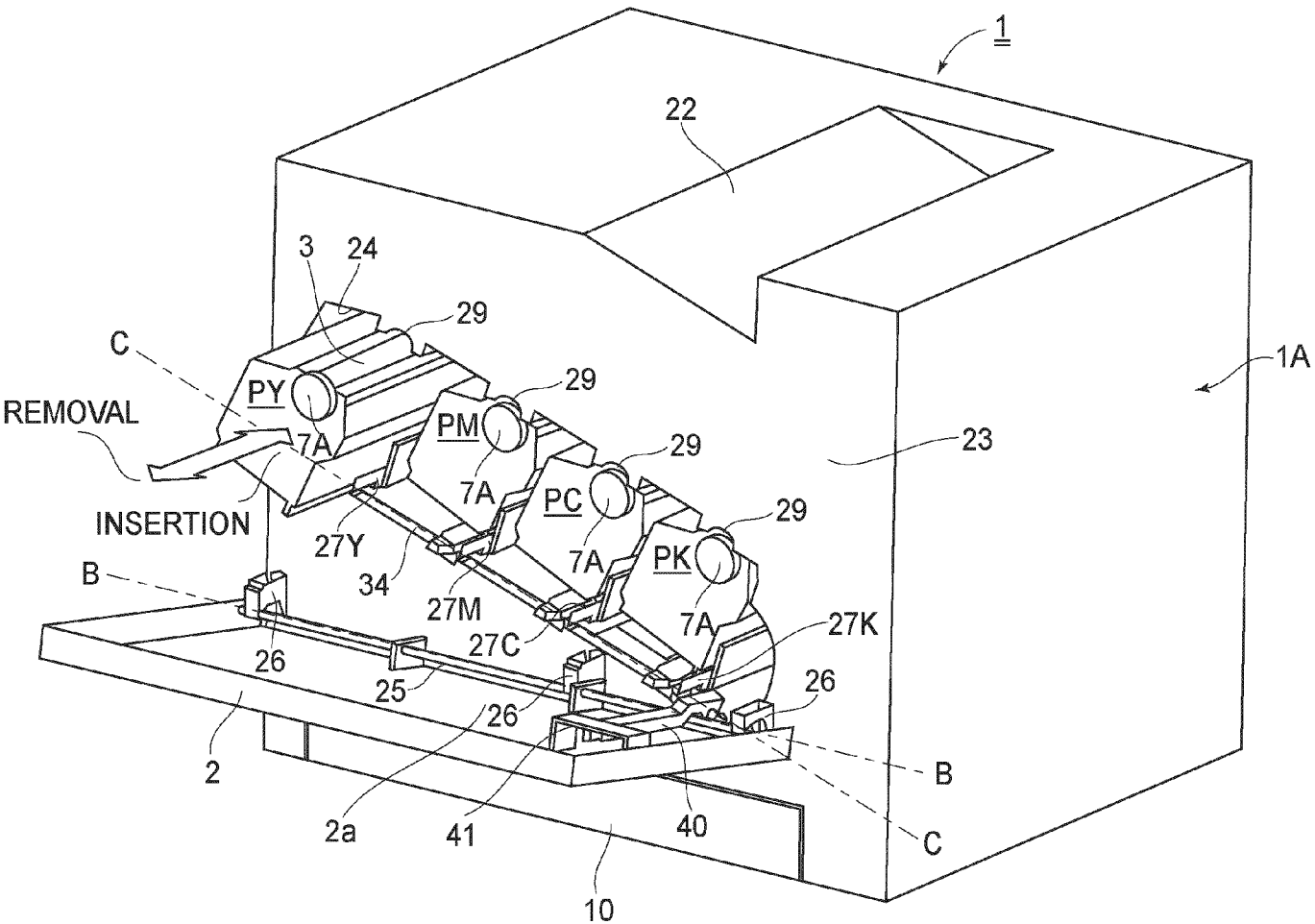
FIG. 3 is an outer appearance perspective view of the image forming apparatus in which the front door is opened, and wherein, the first process cartridge is pulled out halfway.

FIG. 1 is a schematic longitudinal sectional view of an image forming apparatus 1 of the present embodiment. FIG. 2 is an outer appearance perspective view of the image forming apparatus 1 in the state where a front door (exterior cover) 2 is closed. FIG. 3 is an outer appearance perspective view of the image forming apparatus 1 in which the front door 2 is opened wherein, a first process cartridge PY is pulled out halfway.

This image forming apparatus 1 is a full-color laser beam printer (four colors) which uses an electrophotographic process, and forms the color image on the recording material. This image forming apparatus 1 is the process cartridge mounting and dismounting type in which the first-fourth process cartridges P (PY, PM, PC, PK) are mountable and dismountable relative to the main assembly of the image forming apparatus 1A.

This image forming apparatus 1 is a full-color laser beam printer (four colors) which uses the electrophotographic process, and forms a color image on a recording material.

Here, in the image forming apparatus 1 of the embodiment, a front side or a front side is a side which has a front door 2. A rear surface side or a rear side is an opposite side. A front-rear direction is the direction (front) to the front side from the rear surface side, and the opposite direction (back) thereto. Right and left are the left and the right, seeing from the front side. A left-right directions is the direction (leftward direction) form the right to the left, and the reverse direction (rightward direction) thereof. The main assembly of the image forming apparatus (apparatus main assembly) 1A is the portion of an image forming apparatus other than the process cartridge. Relating to the process cartridge (cartridge) P, the constituent members thereof, or constituent members of the apparatus main assembly, a longitudinal direction is an axial direction of a photosensitive drum (drum) 3 which is the image bearing member or a direction parallel with the axial direction. Relating to the longitudinal direction of the cartridge P, a side which receives a driving force from the apparatus main assembly 1A is a driving side, and the opposite side is a non-driving side.

A cartridge accommodating portion 1B for containing the cartridges P is provided in a central portion in the apparatus main assembly 1A.

The first through fourth cartridges P (PY, PM, PC, PK) are accommodated in this accommodating portion 1B with the longitudinal directions thereof being in the front-rear direction, and they are obliquely arranged (right side down), and they are positioned in the image forming positions. More particularly, a first cartridge PY at the most left-hand side takes the highest position, a second cartridge PM is lower than it, a third cartridge PC is still lower, and a fourth cartridge PK at the most right-hand side is the lowest.

When the cartridges P are set at image formation positions in the accommodating portion 1B, there is a phantom plane E including rotation axes O of the drums 3 of the cartridges P. The phantom plane E inclines relative to the horizontal plane F, and an inclination angle thereof is theta. In this embodiment, the inclination angle theta is approximately 20 degrees. Thus, the width of the horizontal direction of the apparatus main assembly 1A can be reduced by obliquely arranging the cartridges P.

The cartridges P have the similar electrophotographic processing mechanisms and differ in the colors of the developers (toner) and the loading weight of the toner. In the accommodating portion 1B, a rotational driving force is transmitted from the apparatus main assembly 1A to each cartridge P mounted to the image formation position, and, in addition, bias voltages (charging bias voltage, developing bias, and so on) are supplied (unshown).

Each cartridge P of the present embodiment contains integrally the drum 3, the charging means 4 as the process means which acts on this drum 3, the developing means 5, and the cleaning means 6, in the cartridge frame 7. The charging means 4 includes a charging roller. The developing means 5 includes a developing roller. The cleaning means 6 includes a cleaning blade.

Figure 4:
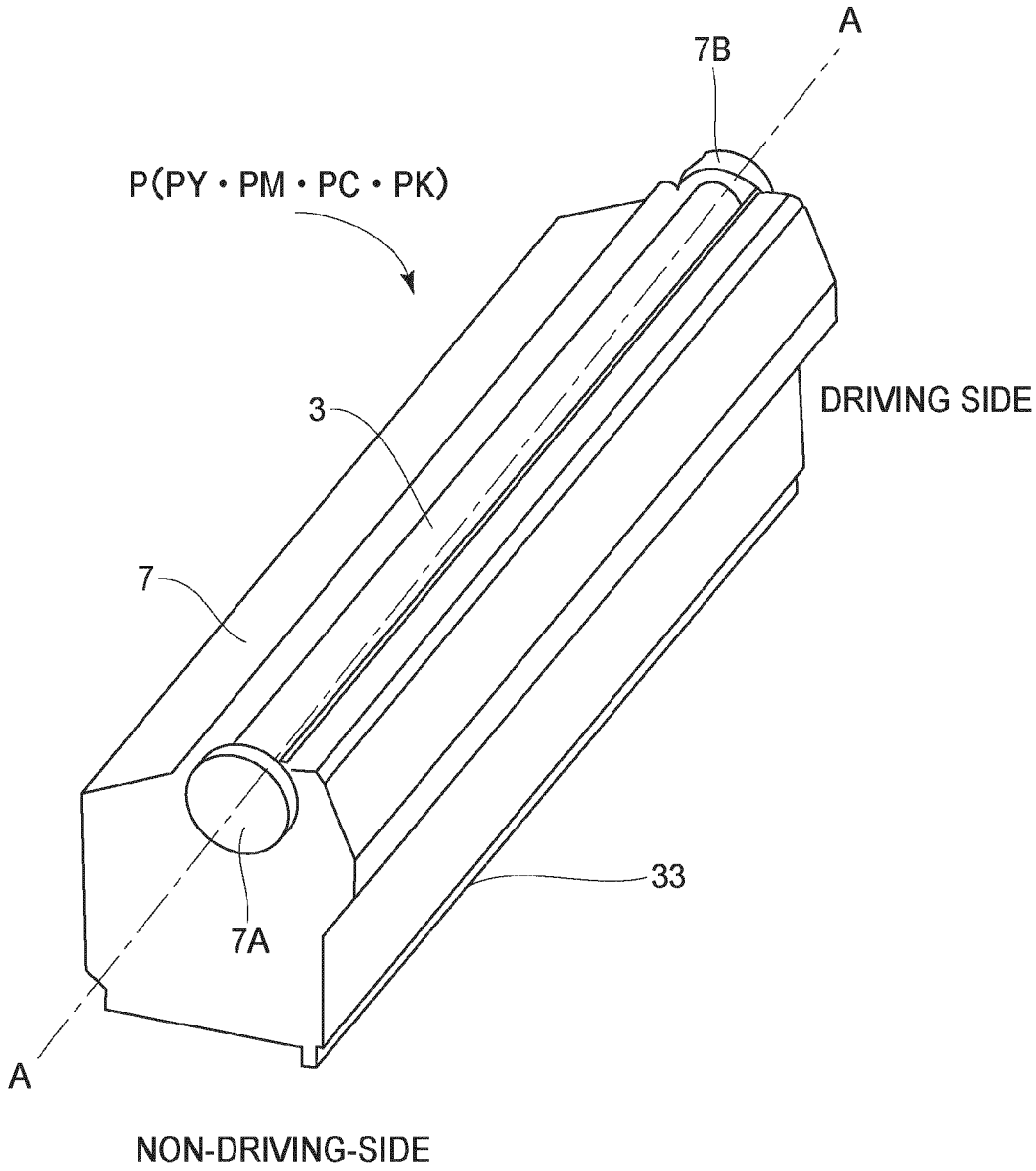
FIG. 4 is an outer appearance perspective view of the cartridge, as seen from a non-driving side.

FIG. 4 is an outer appearance perspective view of the cartridge P, as seen from the non-driving side. The cartridge P is an assembly elongated in an axial direction A-A of the drum 3. The one and the other ends with respect to the longitudinal direction of the drum 3 are rotatably supported between the first bearing member (non-driving side) 7A and the second bearing member 7B (driving side) which are disposed at the one and the other ends of cartridge frame 7, respectively.

The first cartridge PY contains the toner of the yellow (Y) color in a developer container thereof, and forms a toner image of the Y color on the surface of the drum 3. The second cartridge PM contains the toner of the magenta (M) color in a developer container thereof, and forms a toner image of the M color on the surface of the drum 3. The third cartridge PC contains the toner of the cyan (C) color in a developer container thereof, and forms a toner image of the C color on the surface of the drum 3. The fourth cartridge PK contains the toner of the black (K) color in a developer container thereof, and forms a toner image of the K color on the surface of the drum 3.

Below each cartridge P, a laser scanner 8 as image information exposure means for the drum 3 of each cartridge P is disposed.

In addition, below the laser scanner 8, a feeding unit 9 is disposed. The feeding unit 9 includes a sheet feeding cassette 10 which stacks the recording material (transfer material, final recording material) S, a sheet feeding roller 11 and a separation part 12, a registration roller pair 13, and so on An intermediary transfer unit 14 is provided above each cartridge P. This unit 14 includes transferring means (primary transfer) for transferring superimposedly onto an intermediary transfer belt (first recording material, transfer belt) 15 the toner images formed on the drum 3 of each cartridge P (PY, PM, PC, PK). The unit 14 includes parallel driving roller 16 and a parallel tension roller 17, and the flexible endless transfer belt 15 is extended around the rollers 16 and 17. And, the transfer belt 15 is obliquely disposed relative to the horizontal direction.

In the accommodating portion 1B, an upper surface of the drum 3 of each cartridge P mounted to the image formation position is in contact with a lower surface of a lower part of the transfer belt 15. The contact portion there is the primary transfer portion. A primary transfer roller 18 is provided at the position opposed to each drum 3 inside the transfer belt 15. The transfer belt 15 is traveled by the driving roller 16 at a speed corresponding to a rotational speed of the drum 3 counterclockwisely (arrow). A predetermined primary transfer voltage is applied at the predetermined control timing to the primary transfer roller 18. A secondary transfer roller 19 is urged through the transfer belt 15 toward the driving roller 16. A contact portion between the secondary transfer roller 19 and the transfer belt 15 is a secondary transfer portion. A predetermined secondary transfer voltage is applied at the predetermined control timing to the secondary transfer roller 19.

A fixing unit 20 and a sheet discharging unit 21 are provided in the upper right portion in the apparatus main assembly 1A. The upper surface of the apparatus main assembly 1A constitutes a sheet discharge tray 22.

The operations for forming the full-color image will be described. The controller (control circuit portion, unshown) starts an image forming operation of the image forming apparatus in response to a printing signal. More particularly, the drums 3 of the firsts-fourth cartridges P (PY, PM, PC, PK) are rotated at the predetermined speed in the counterclockwise direction. The transfer belt 15 is also rotated at the speed corresponding to the speed of the drum 3 clockwisely (codirectional relative to the peripheral surface movement of the drum). The laser scanner 8 is also driven. In synchronism with the drive, in each cartridge P, the surface of the drum 3 is uniformly charged to the predetermined potential of the predetermined polarity by the charging roller 4 which is supplied with predetermined electrification voltage. The laser scanner 8 scanningly exposes the surface of each drum 3 to the laser beam L (LY, LM, LC, and LK) modulated correspondingly to the image information signal of each color. The laser beam LY, LM, LC, LK outputted from the laser scanner 8 enters a cartridge frame 7 through a slit window 7*a* provided in the bottom surface of the correspondence cartridge P to illuminate the lower surface of the drum 3, by this, the electrostatic latent images corresponding to the image information signals of the corresponding colors are formed on the surfaces of the drums 3. The formed electrostatic latent images are developed as the toner images by the developing rollers 5.

AY color toner image corresponding to the yellow component of the full-color image is formed on the drum 3 of the first cartridge PY by the above described electrophotographic image forming process operation. The toner image is transferred onto the transfer belt 15 (primary transfer). Similarly, an M color toner image corresponding to the magenta component of the full-color image is formed on the drum 3 of the second cartridge PM. The toner image is superimposedly transferred onto the toner image of the Y color already transferred on the transfer belt 15 (primary transfer). Similarly, a C color toner image corresponding to the cyan component of the full-color image is formed on the drum 3 of the third cartridge PC. The toner image is superimposedly transferred onto the toner image of Y color+M color already transferred on the transfer belt 15 (primary transfer). Similarly, a K color toner image corresponding to the black components of the full-color image is formed on the drum 3 of the fourth cartridge PK. The toner image is superimposedly transferred onto the toner image of Y color+M color+C color already transferred on the transfer belt 15 (primary transfer).

Thus, the full-color toner image of color+M color+C color+K Y Color is synthesized on the transfer belt 15 (unfixed).

In each cartridge P, the untransferred toner which remains on the surface of the drum 3 after the primary transfer is removed by a cleaning blade 6.

On the other hand, in the feeding unit 9, the recording material (second recording material) S is separated and fed at the predetermined control timing from the sheet feeding cassette 10. The recording material S is introduced into a secondary transfer portion which is the contact portion between the secondary transfer roller 19 and the transfer belt 15, by the registration roller pair 13 at the predetermined control timing. A predetermined secondary transfer voltage is applied to the secondary transfer roller 19. By this, the four color superimposed toner images on the transfer belt 15 are transferred onto the surface of the recording material S all together sequentially in the process in which the recording material S is nipped and fed in the secondary transfer portion (secondary transfer).

The recording material S is separated from the surface of the transfer belt 15, is upwardly fed, and is introduced into a fixing unit 20, where it is heated and pressed by the fixing nip. By this, the fixing to the recording material S of synthesized color toner image is made. And, the recording material S is discharged out of the fixing unit 20 by a sheet discharging unit 21 onto a sheet discharge tray 22 as the full-color print.

<<Process Cartridge Exchanging Type>>

In the cartridge P mounted to the apparatus main assembly 1A, the toner contained in the developing means is consumed with the usage thereof for the image formation. In this embodiment, the detecting means (unshown) for sensing a toner residue of each cartridge is provided in the cartridge. The controller compares a remaining amount value sensed by the detecting means with the threshold for the cartridge lifetime warning and the lifetime warning which were set beforehand. For the cartridge which the remaining amount value of the toner has reduced to remaining amount values smaller than the threshold, the lifetime warning or the lifetime warning of the cartridge is displayed on the indication area (unshown). By this, preparation of the cartridge for the exchange is prompted, or exchange of the cartridge is prompted to maintain the quality of the output image.

In the image forming apparatus of the present embodiment, in the case of the exchange of the cartridge P, a front door 2 which is an opening and closing member of the apparatus main assembly 1A is opened as shown in FIG. 3 (front access type). Designated by 2*a* is a grip portion provided on the front door 2. The sheet feeding cassette 10 of the feeding unit 9 is also taken out and in by the front access. Designated by 10*a* is a grip portion provided on the sheet feeding cassette 10.

In order to insert the cartridge P in the apparatus main assembly 1A, and in order to take out the cartridge P from the inside of the apparatus main assembly 1A, the opening 24 (opening for carrying out the mounting and demounting of the cartridge) is provided in the front plate 23 of the apparatus main assembly 1A. A mounting and demounting direction of the cartridge P relative to the apparatus main assembly 1A is the axial direction of the drum 3.

On the front plate 23 of the apparatus main assembly 1A, a front door 2 as an opening and closing member movable between the closed position which covers and closes the opening 24, and the open positions which releases the opening 24, is provided.

In this embodiment, this front door 2 is rotatable about a door rotation shaft (first rotation shaft) 25 which is provided on the lower side and is extended horizontally, and it can take an open position which opens the opening 24, and a closed position which closes the opening 24. The door rotation shaft 25 is rotatably supported on a bearing member 26 provided in the front plate 23 of the apparatus main assembly 1A. In this embodiment, in consideration of the user's door operationality, an axial direction B-B of the door rotation shaft 25 is the left-right direction, and is a horizontal direction. The front door 2 is rotated through substantial 90 degrees toward the front side about the door rotation shaft 25 from the rotation angle attitude (closed position) substantially vertical, and this position is a substantial horizontal rotation angle attitude (open position).

Figure 5:
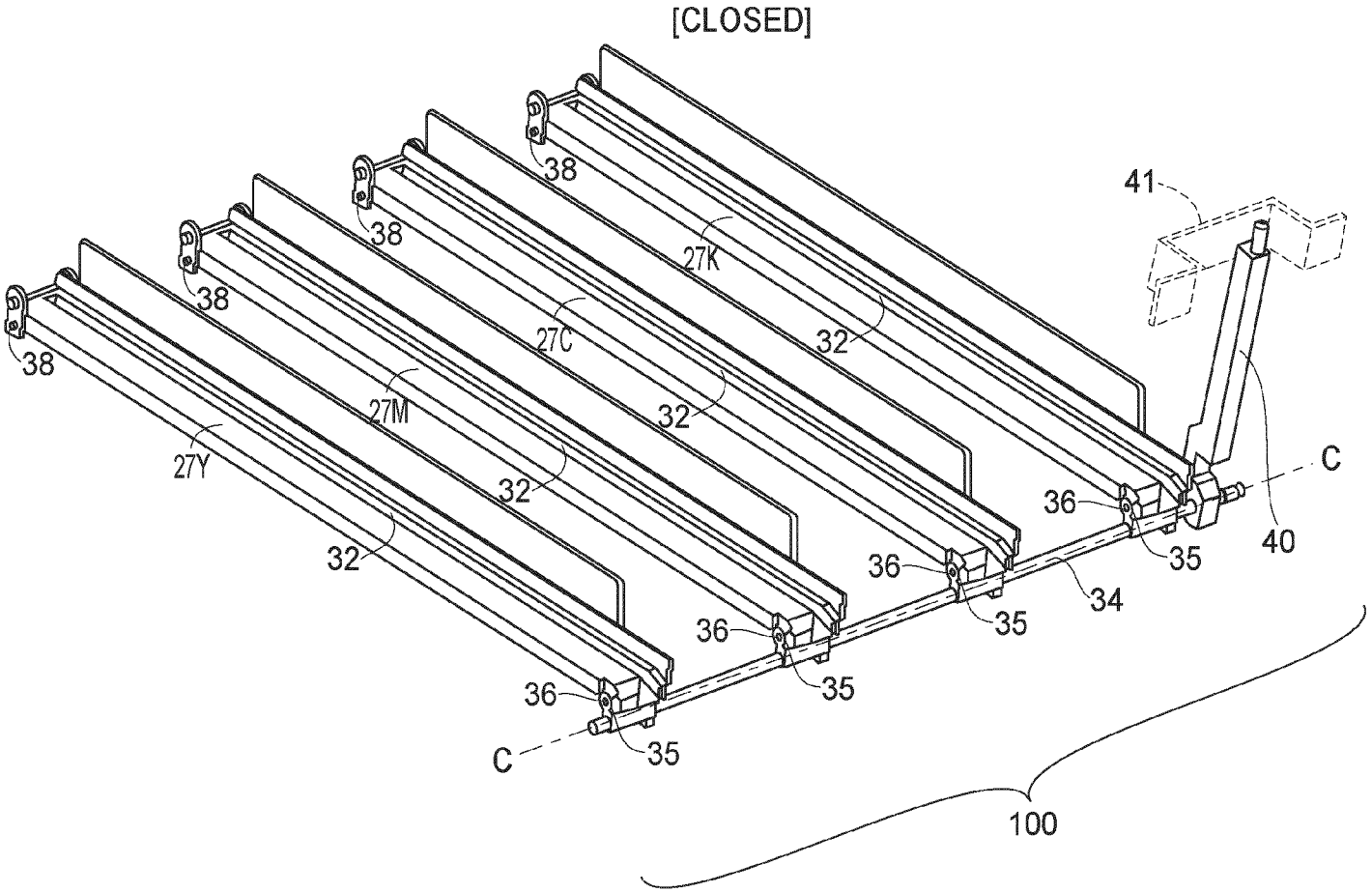
FIG. 5 is a perspective view (at the time of the door closed state) of the supporting member for the first-the fourth cartridge.

In the cartridge accommodating portion 1B (inside of the main assembly of the image forming apparatus) of the apparatus main assembly 1A, the first through fourth cartridge supporting members 27 (27Y, 27M, 27C, 27K) for supporting the firsts-fourth cartridges P (PY, PM, PC, PK) are provided. FIG. 5 is a perspective view of the cartridge supporting members (supporting member) 27.

The longitudinal direction of each supporting member 27 is aligned with the front-rear direction, and is obliquely disposed similarly to the arranging direction of the cartridge P (PY, PM, PC, PK) (right side down). More particularly, the first supporting member 27Y of most left-hand side is the highest, the second supporting member 27M is lower than it, the third supporting member 27C is still lower, and the fourth supporting member 27K of most right-hand side is the lowest.

Each supporting member 27 is movable by the raising and lowering mechanism operated interrelatedly with the opening and closing movement of the front door 2 between the first position which positions the cartridge P in the image formation position relative to the apparatus main assembly 1A, and the second position positioned in the detachably mountable mounting and dismounting position relative to the apparatus main assembly 1A. In addition, the drum 2 contacts to the transfer belt 15 in the first position. Furthermore, the drum 2 spaces from the transfer belt 15 in the second position. In other words, each supporting member 27 can take the first position in which the drum 2 is contacted to the transfer belt 15 when the door 2 positions at the closed state, and the second position which makes the drum 2 space from the transfer belt 15 when the door 2 positions at the opened state.

The movement direction of each supporting member 27 is the direction perpendicular to the arranging direction of each cartridge P described above, and each cartridge P rises and lowers in this direction. The raising and lowering mechanism in interrelation with the opening and closing movement of the front door 2 will be described hereinafter.

In this embodiment, each supporting member 27 is raised to the first position by the raising and lowering mechanism in interrelation with the closing rotation of the front door 2. In addition, each supporting member 27 is lowered to the second position by the raising and lowering mechanism in interrelation with the opening rotation of the front door 2.

Figure 7:
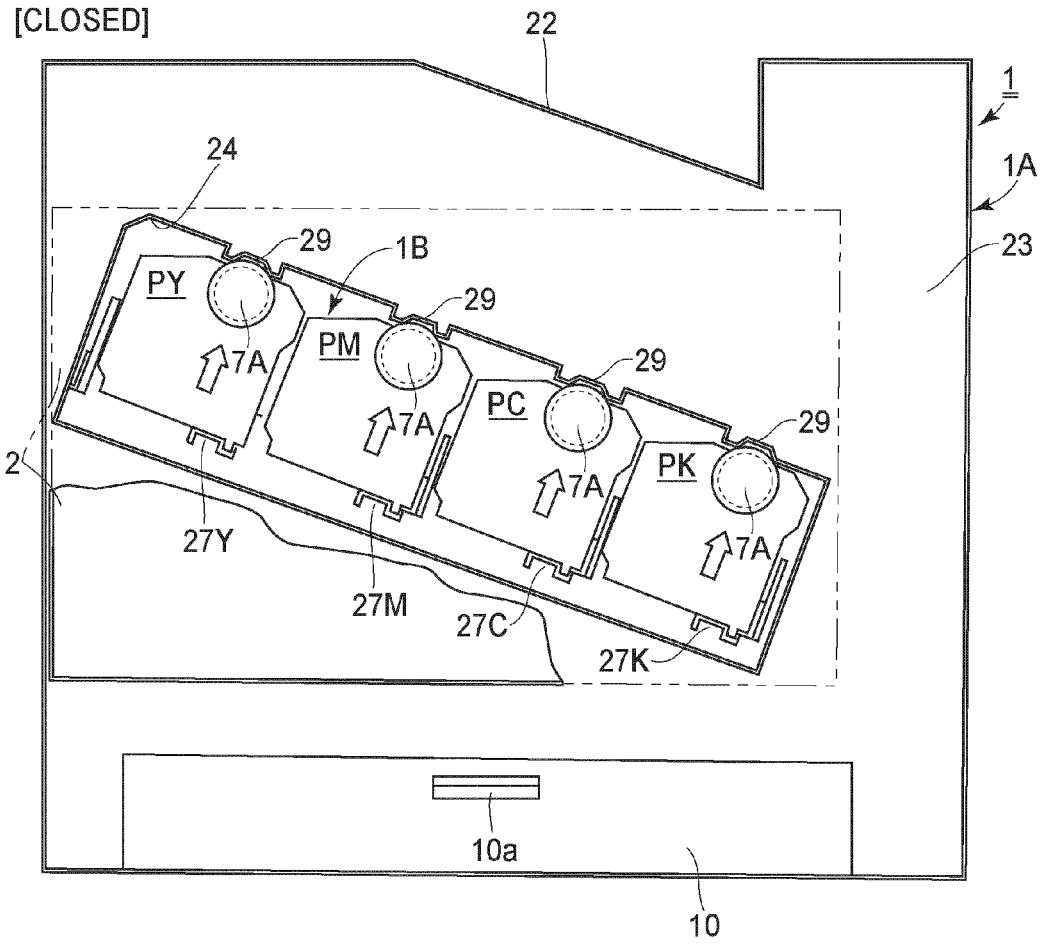
FIG. 7 is an illustration in the state where each cartridge is positioned in a mount position.
Figure 8:
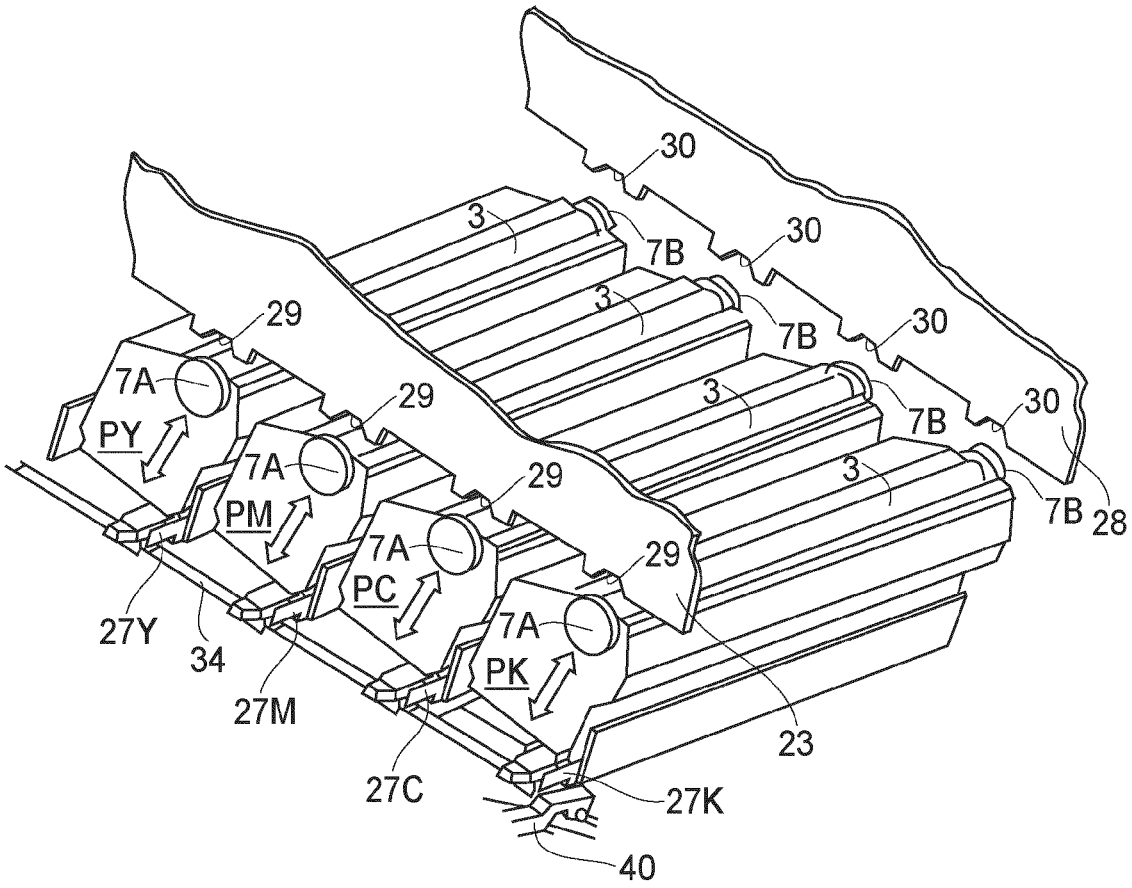
FIG. 8 is an illustration of the positioning portion of each cartridge, and the positioning portion of the apparatus main assembly.
Figure 12:
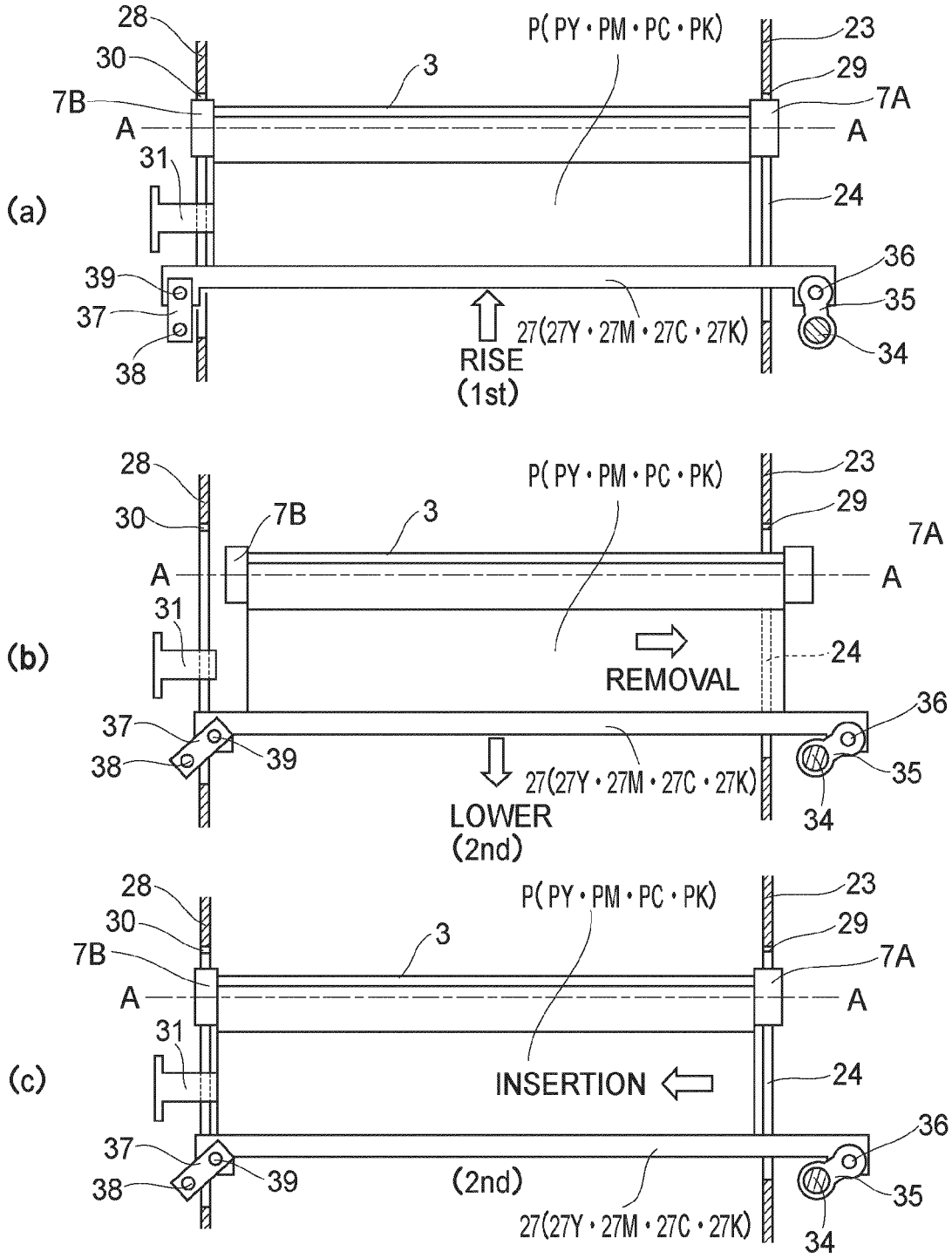
FIG. 12 is an illustration of an operation of the cartridge supporting member and mounting and insertion and detachment of cartridge.

FIG. 7 and (a) of FIG. 12 shows the state where the rising movement of each supporting member 27 is carried out, and it is in the first position. In this state, the upper surface portions of the first bearing members and the second bearing members 7A, 7B of each cartridge P are pressed against the positioning portions (abutting portions) 29 and 30 provided in the front plate 23 and rear plate 28 of the apparatus main assembly 1A, respectively. The positioning portion 29 has a notched recess of an L configuration, and the recess engages it with the circle surface portions of the upper surfaces of the first bearing member and the second bearing member 7A, 7B which are the positioning portions of the cartridge. By this, each cartridge P is positioned and maintained at the image formation position relative to the apparatus main assembly 1A. In this mount position, the upper surface of the drum 3 of each cartridge P is in contact with the lower surface of the lower belt portion of the transfer belt 15, as shown in FIG. 1. In addition, in this mount position, the transmission of the rotational driving force and the supply of the bias voltage from the apparatus main assembly 1A are possible to each cartridge P.

Figure 9:
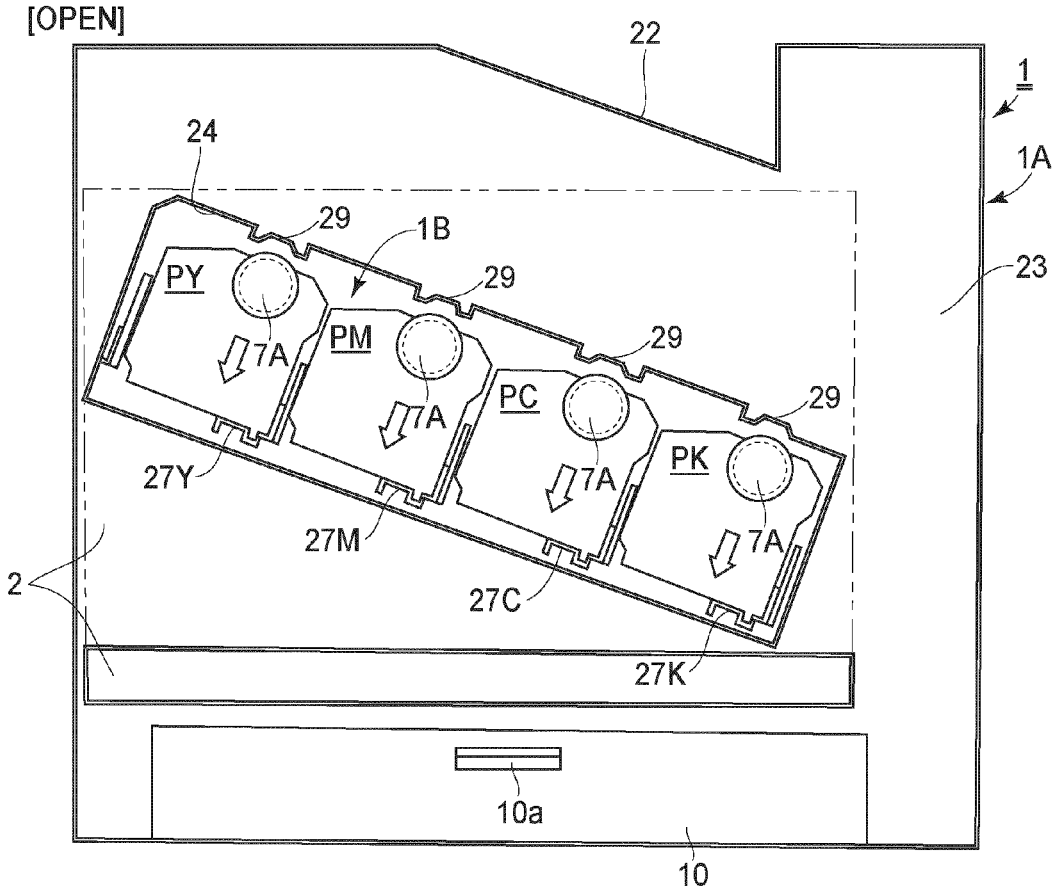
FIG. 9 is an illustration in the state where each cartridge is positioned in the mounting and dismounting position.
Figure 10:
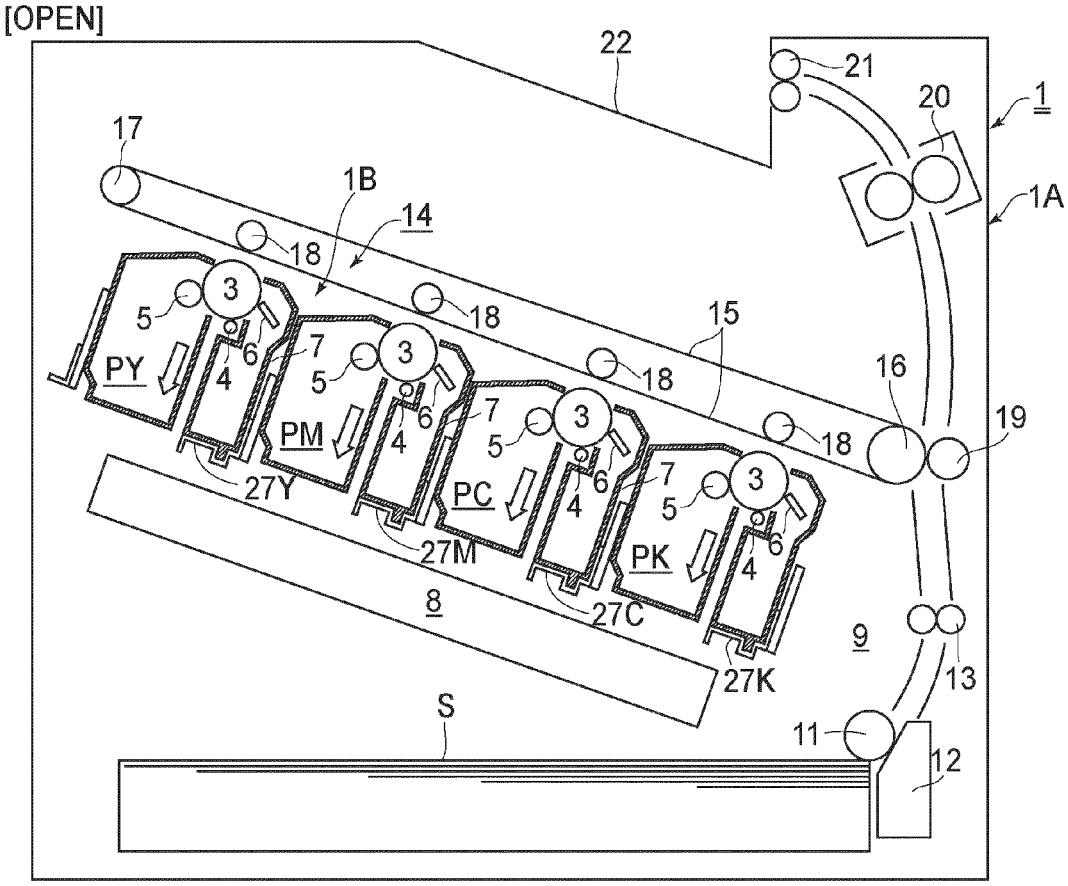
FIG. 10 is a view showing the state where each cartridge positions at the mounting and dismounting position, and the photosensitive drum spaces from the intermediary transfer belt.

FIG. 9 and (b) of FIG. 12 shows the state where each supporting member 27 is in the second position. In this state, The upper surface portions of the first bearing member and the second bearing member 7A, 7B of each cartridge P space from the positioning portions 29 and 30 of the apparatus main assembly 1A to release the pressing against the positioning portions 29 and 30. By this, each cartridge P is retained in the mounting and dismounting position wherein it is detachably mountable relative to the apparatus main assembly 1A. In this mounting and dismounting position, the upper surface of the drum 3 of each cartridge P spaces from the lower surface for the lower part of the transfer belt 15 as shown in FIG. 10. The transmission of the rotational driving force and the supply of the bias voltage from the apparatus main assembly 1A to each cartridge P are not possible.

In the case of the mounting and demounting of the cartridge P relative to the apparatus main assembly 1A, the front door 2 is sufficiently opened as shown in FIG. 3, and the opening 24 is exposed. More particularly, each supporting member 27 descends from the first position to the second position by the raising and lowering mechanism in interrelation with the opening rotation of the front door 2 ((a)→(b) of FIG. 12). By this, each cartridge P is moved to the mounting and dismounting position relative to the apparatus main assembly 1A. In this state, the cartridge P which should be exchanged is slid through the opening 24 to the front on the supporting member 27 which supports it, and is taken out from the apparatus main assembly 1A. In the case of the insertion of the cartridge P into the apparatus main assembly, the cartridge P is slid and inserted into the apparatus main assembly 1A through the opening 24 with the driving side at the leading side.

The insertion of the cartridge P is sufficiently carried out until the driving side of the cartridge P is abutted to the regulating portion 31 of the rear side in the apparatus main assembly 1A ((c) of FIG. 12).

Figure 6:
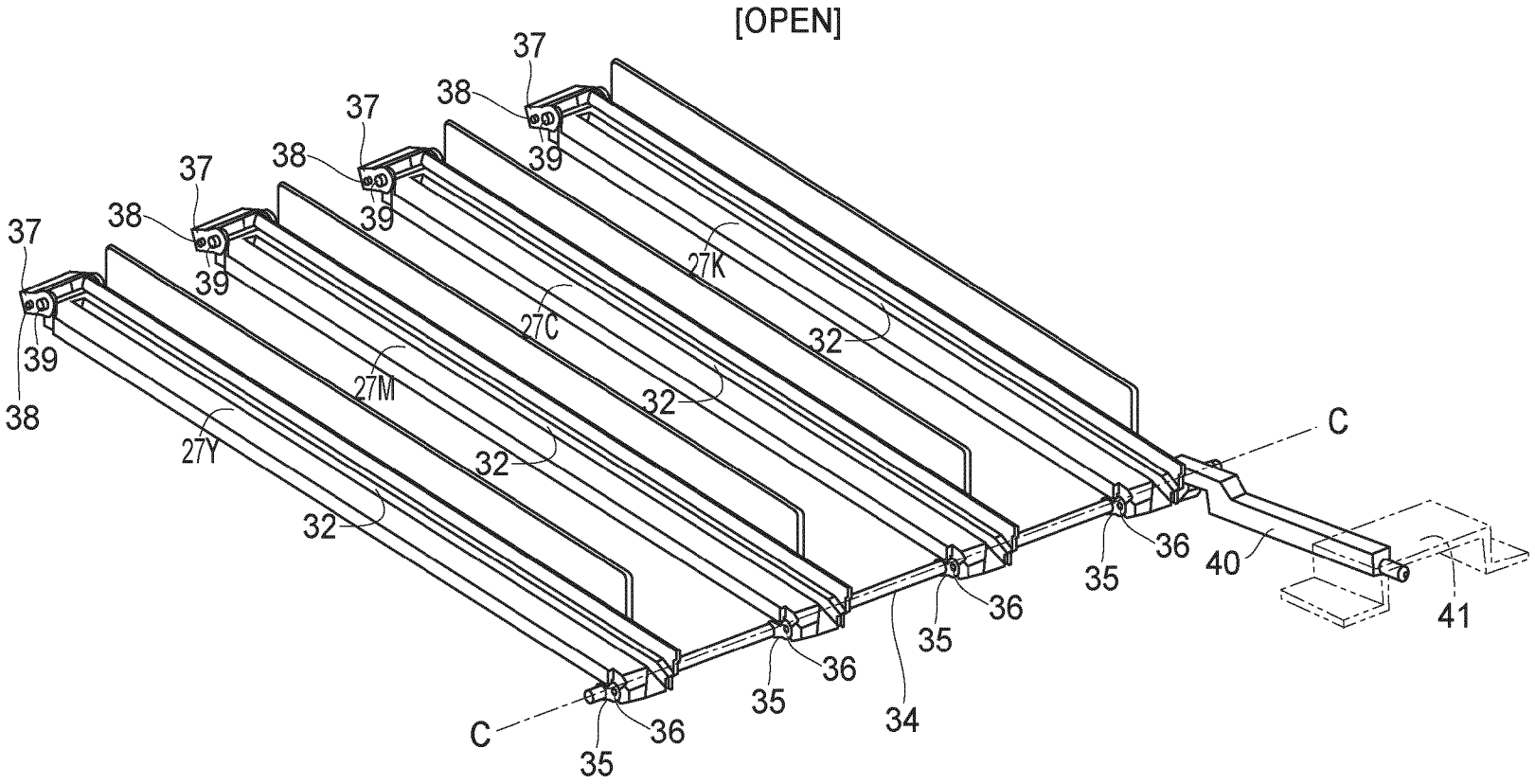
FIG. 6 is a perspective view (at the time of the door opened state) of the supporting member for the first-the fourth cartridge.

A groove (regulating portion) 32 which extends along the longitudinal direction, i.e., the mounting and demounting direction, as shown in FIG. 5 and FIG. 6, is provided in the upper surface of each supporting member 27. In addition, a rib 33 (FIG. 4) corresponding to the groove 32 is extended in the longitudinal direction on the lower surface of the cartridge P. The deviation out of the mounting and demounting direction of the cartridge P is prevented by the engagement between this groove 32 and the rib 33 at the time of the mounting and demounting of the cartridge P.

In this manner, each supporting member 27 has the function as the guiding member for preventing deviation of the cartridge. In addition, each supporting member 27 supports the cartridge P in the lower part, and it pushes the cartridge up to abut the positioning portions 7A, 7B of the cartridge P to the positioning portions 29 and 30 of the apparatus main assembly 1A. By this, the cartridge P is positioned and retained in the mount position in which the image formation is capable.

The raising and lowering mechanism for each supporting member 27 and the interrelating mechanism between the raising and lowering mechanism and the front door 2 will be described.

Figure 11:
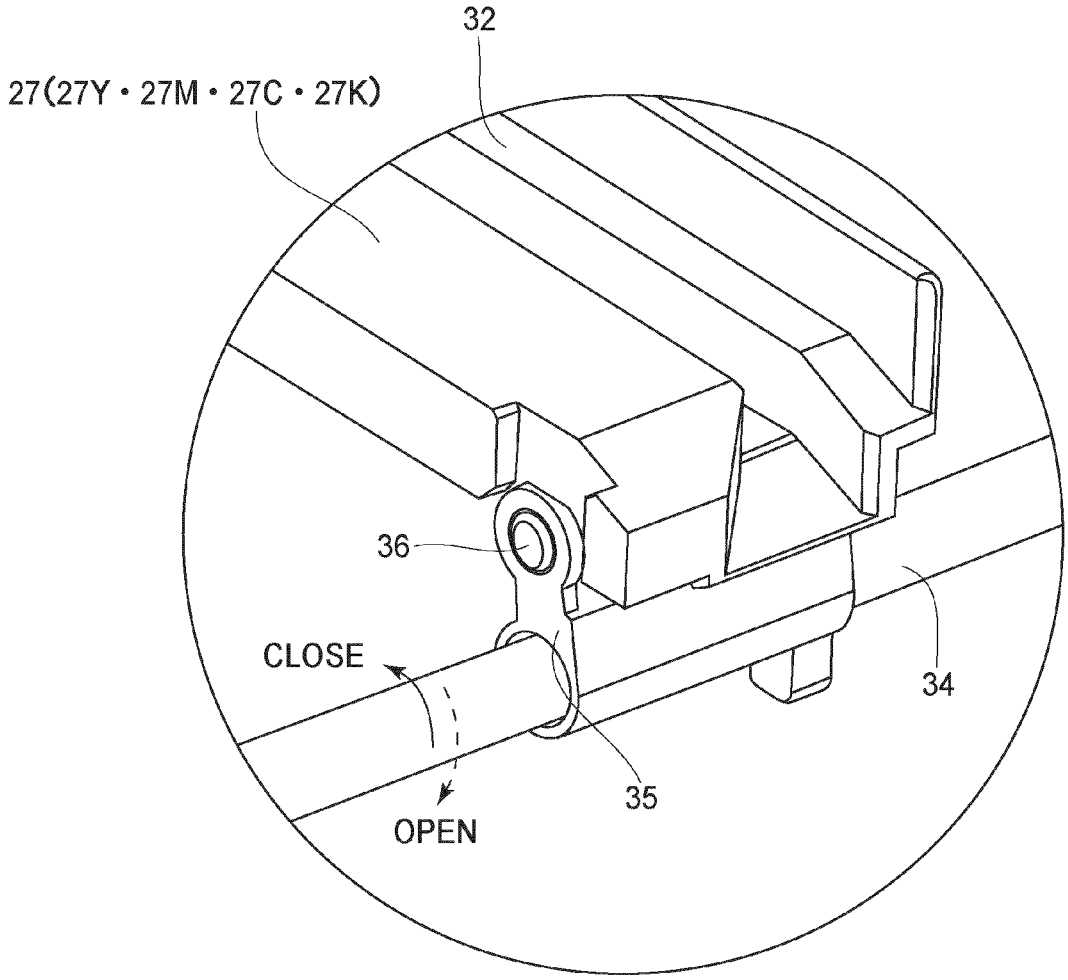
FIG. 11 is an enlarged view of a portion of an arm member.

The interrelating mechanism between the raising and lowering mechanism and the front door 2 includes a connecting member 100 for moving the supporting member 27 between the first position and the second position in interrelation with the front door 2. The connecting member 100 is rotatable relative to the main assembly of the image forming apparatus about a second rotation shaft which inclines horizontally. The first-fourth supporting members 27 (27Y, 27M, 27C, 27K) are coupled by the connecting member 100. The connecting member 100 comprises a connecting shaft 34, a first arm member (first coupling portion) 35, and a link arm 40. The connecting shaft (second rotation shaft) 34 has an axis C-C crossing with a rotation axis B-B of the front door 2, seeing in the direction of mounting the cartridge P to the apparatus main assembly 1A. The first arm member 35 and the link arm 40 are fixed to the connecting shaft 34. The link arm 40 is fixed to the connecting shaft 34 at the position nearer the front door 2 than the first arm member 35 with respect to the direction of the axis C-C. The direction of the axis C-C of the connecting shaft 34 is perpendicular to the rising and lowering direction of the cartridge P. That is, it is substantially parallel to the arranging direction of the cartridges P. The connecting shaft 34 is rotatably supported on a bearing member (unshown) provided in the front plate 23 of the apparatus main assembly 1A. The front side ends of the supporting members 27 are connected with each other through the connecting shaft 34 and the first arm member 35 which are rotatable integrally. The front side ends of the supporting members 27 are supported rotatable about the connecting shaft 36 on the corresponding arm member 35. FIG. 11 is a partly enlarged view of an arm member 35. A rear side end of each supporting member 27 is coupled with the apparatus main assembly 1A through a link 37. Designated by 38 is a connecting shaft between the apparatus main assembly 1A and the link 37, and 39 is a connecting shaft between the link 37 and the rear side end of the supporting member 27. In each supporting member 27, the center-to-center dimension between the shaft 38 and shaft 39 of the link 37 is the same as the center-to-center dimension between the shaft 34 and shaft 36 of the arm member 36.

In other words, the supporting member 27 constitutes a parallelogram linkage by the connecting shaft 34, the arm member 36, the link 37, the shaft 38, and the shaft 39. For this reason, each supporting member 27 makes oblique translation movement by the rotation of the connecting shaft 34. Each supporting member 27 raises the cartridge P to the image formation position (first position) relative to the apparatus main assembly 1A as shown in (a) of FIG. 12 by the connecting shaft 34 rotating in the direction of raising the arm member 35. In addition, each supporting member 27 lowers the cartridge P to the detachably mountable position (second position) relative to the apparatus main assembly 1A as shown in (b) of FIG. 12 by the connecting shaft 23 rotating the arm member 35 in the direction moved to the front side. In this manner, the connecting shaft 34 operates each supporting member 27 together. In the above described raising and lowering mechanism, all the distances between the first-fourth supporting members 27 and the connecting shaft 34 are equal, and the operations are common, and therefore, the mechanism is simple and can cause neither malfunction nor the failure easily. In addition, since the useless space is not required, the downsizing of the device can also be accomplished. In addition, since it is not necessary to use the different parts for the respective colors, the communalization of the parts can be accomplished and it is advantageous in cost.

The rising and lowering of the first-fourth supporting members 27 by the above described raising and lowering mechanism is performed in interrelation with the opening and closing operation of the front door 2.

More particularly, the second coupling portion (link arm 40) extended in the substantially perpendicular direction relative to the shaft 34 is fixed to the right side end of the connecting shaft 34 for the integral rotation with the connecting shaft 34. In addition, the free end portion of the link arm 40 is enclosed by an engaging portion (box shape portion 41) provided inside of the front door 2, and is in engagement with the front door 2.

When the front door 2 rotates about the door rotation shaft 25 from the open position to the closed position, the free end portion of the link arm 40 is pushed by the pressing portion (internal surface 2*a* (FIG. 3)) of the front door 2, and rotates the connecting shaft 34.

Here, the door rotation shaft 25 (axis B-B) which is the rotation axis of the front door 2, and the connecting shaft 34 (axis C-C) are not parallel with each other, and the angles thereof differ from each other. In other words, the connecting shaft 34 which is the second rotation shaft is perpendicular to the mounting and demounting direction of the cartridge P, and has the angle which is different from that of the door rotation shaft 25 which is the first rotation shaft. Therefore, the contact portion between the free end portion of the link arm 40 and the internal surface 2*a* of the front door 2 moves along the arc-shaped curve on the internal surface 2*a* of the front door 2. In view of this, as for the box shape portion 41 surrounding the free end portion of the link arm 40, latitude is given to the arc movement range of this link arm 40. The box shape portion 41 has the function of engaging the link arm 40 and the front door 2 so that when the front door 2 rotates to the open position from the closed position, the link arm 40 follows the opening operation of the front door 2 to rotate the connecting shaft 34 so as to move the cartridge P to the mounting and dismounting position.

Therefore, in the structure the door rotation shaft 25 and the connecting shaft 34 are not parallel with each other, the supporting members 27 are made to rise and lower integrally in interrelation with the opening and closing operation of the front door 2, and the switching is possible between the first position and the first second position.

In other words, in the image forming apparatus of the present embodiment, since the door rotation shaft (first rotating shaft) 25 of the front door 2 is horizontal, the operativity can be improved. Additionally, the single connecting shaft (second rotating shaft) 34 in parallel with the arranging direction of the cartridges P can perform rising and lowering operations of supporting member 27 compactly, and therefore, the downsizing of the device and the simplification can also be accomplished.

Furthermore, since the change between the first position and the second position of the cartridge P is made in interrelation with the opening and closing operation of the front door 2, it excels also in the maintenance property in the cartridge exchange.

The link arm 40 is fixed to the connecting shaft 34 at the position nearer to the front door 2 than the first arm member 35 with respect to the direction of the axis C-C. By disposing the link arm 40 at the place near the front door 2, it becomes possible to downsize the link arm 40 and the downsizing of the image forming apparatus 1 can be accomplished.

Embodiment 2

Figure 13:
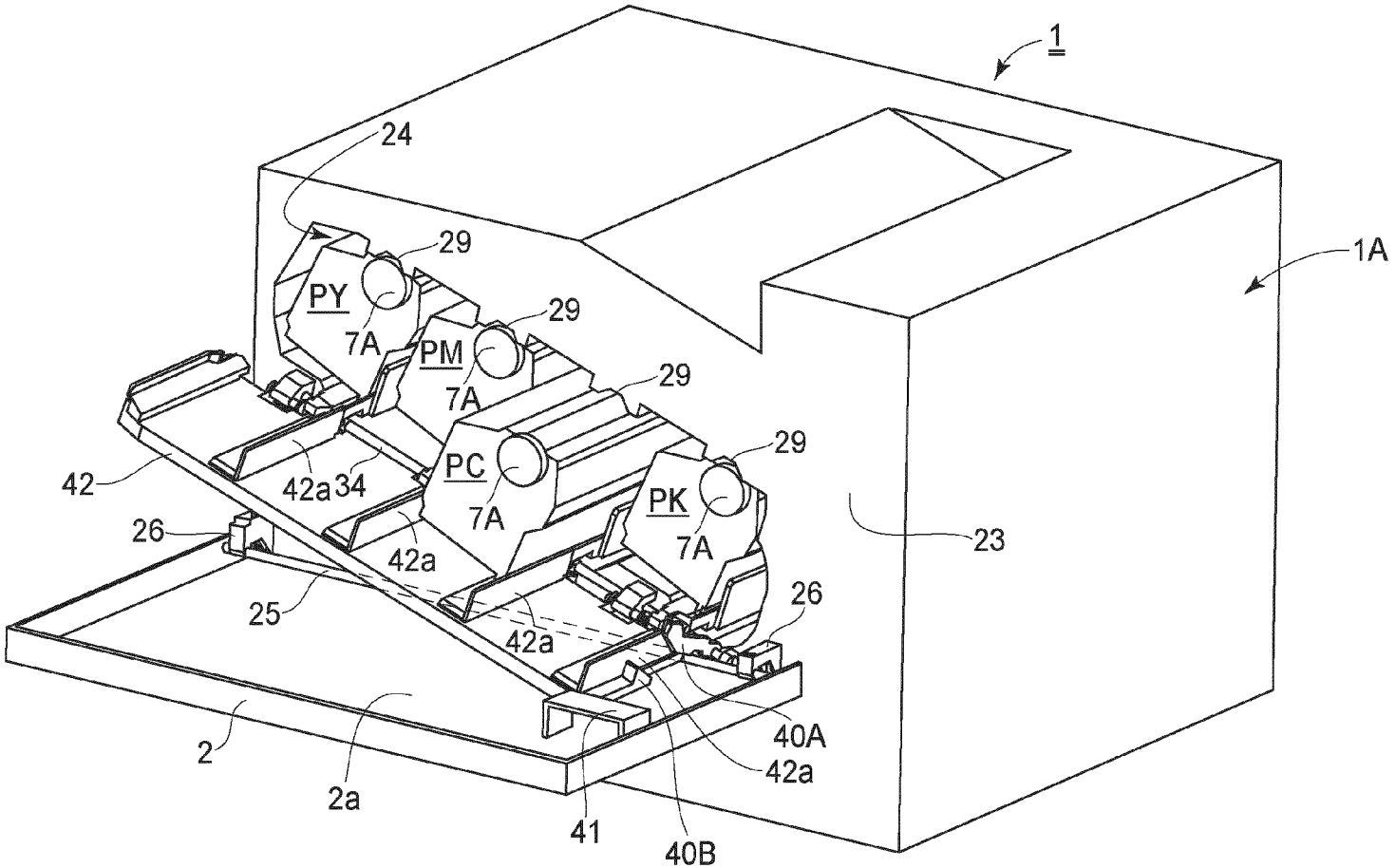
FIG. 13 is an outer appearance perspective view of an image forming apparatus of Embodiment 2 in which a front door is opened wherein, a third process cartridge is pulled out halfway.
Figure 14:
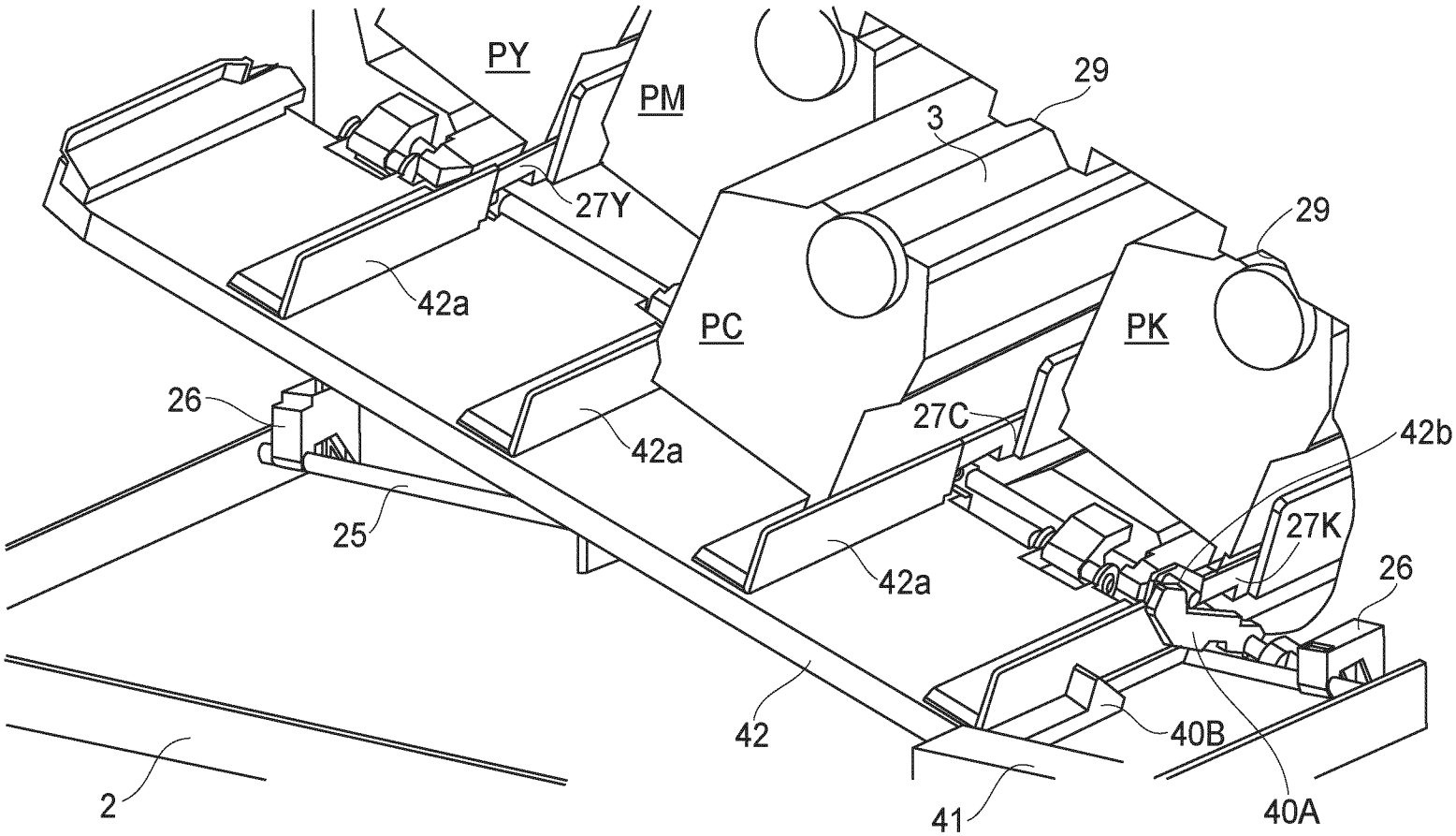
FIG. 14 is a partial enlarged view of FIG. 13.

FIG. 13 is a schematic perspective view of an image forming apparatus 1 according to the second embodiment. FIG. 14 is a partial enlarged view of FIG. 13, and FIG. 15 (*a*) is a partial enlarged view of FIG. 14. In the description of this embodiment, the same reference numerals as in Embodiment 1 are assigned to the elements having the corresponding functions in this embodiment, and the detailed description thereof is omitted for simplicity.

In the image forming apparatus 1, when the front door 2 which is the opening and closing member positions at the open position, the front door 2 is extended toward the outside of the main assembly of the image forming apparatus 1A beyond the opening 24. It is provided with an extension guiding member 42 which is the supporting member for carrying at least a part of cartridge P, and guiding it to the inside of the main assembly of the image forming apparatus 1A at the time of mounting and demounting the cartridge P. This extension guiding member 42 is rotatably provided in the main assembly of the image forming apparatus 1A, and when the front door 2 positions at the closed position, it is accommodated inside of the front door 2. Hereinafter, this will be described.

In the image forming apparatus 1, the extension guiding member 42 is rotatably mounted to the connecting shaft 34. In this embodiment, the link arm 40 is divided into the first link arm 40A and the second link arm 40B. The first link arm 40A is fixed to the connecting shaft 34 so that it may rotate integrally with the connecting shaft 34. The second link arm 40B is integrally mounted to the extension guiding member 42. The free end portion (first engaging portion) of the second link arm 40B is enclosed by the box shape portion 41 which is a third engaging portion provided inside of the front door 2, and is in engagement the front door 2. A first arm member 40A which rotates integrally with the second rotation shaft (connecting shaft 34) and which is engaged with the supporting member 27 is provided on the connecting member 200 for moving the supporting member 27 between the first position and the first second position in interrelation with the front door 2. In addition, a second link arm 40B which rotates integrally with the connecting shaft 34 and which is engaged with the front door 2 is provided on the connecting member 200.

Figure 15A:
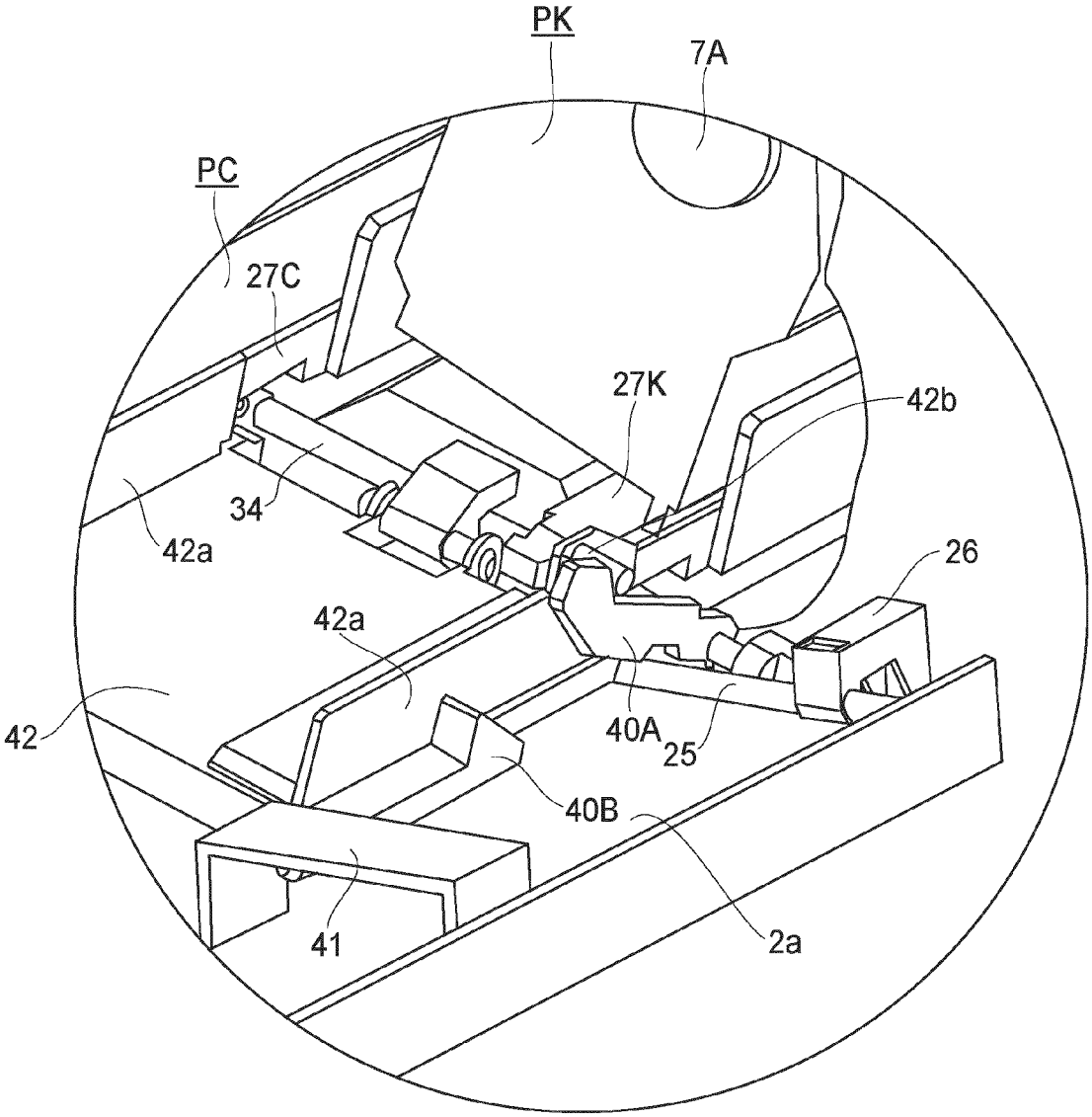
In FIG. 15, (*a*) is a partial enlarged view of FIG. 14.
Figure 15B:
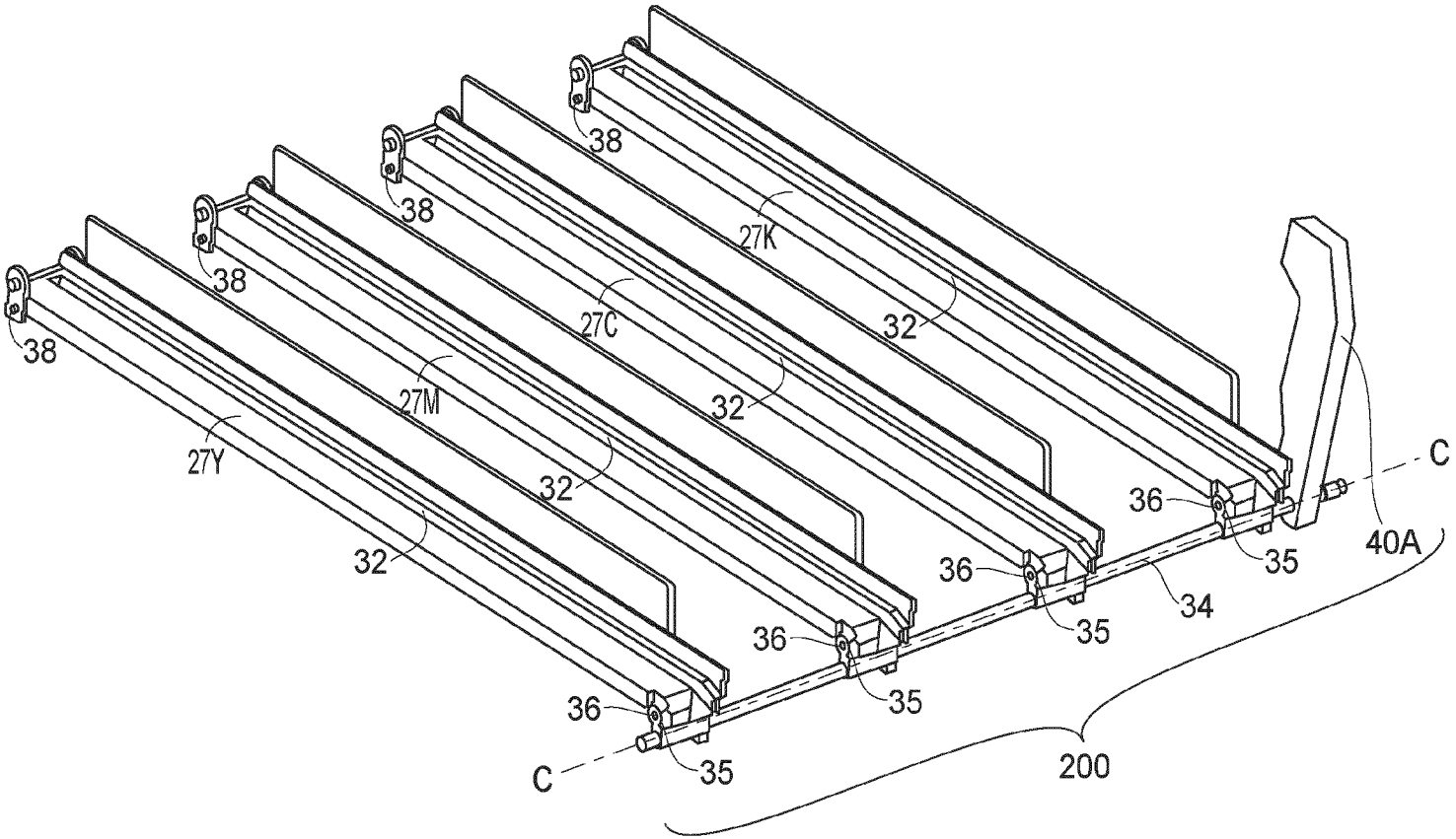

In other words, in this embodiment, the connecting member 200 comprises the connecting shaft 34, the first arm member 35, and the first link arm 40A, as shown in FIG. 15 (*b*).

When the front door 2 is rotated in the closed position about the door rotation shaft 25 from the open position, the free end portion of the second link arm 40B is pushed by a pressing portion (internal surface 2*a*) of the front door 2 to rotate the extension guiding member 42 in the closing direction about the connecting shaft 34. Since the door rotation shaft 25 which is the rotation axis of the front door 2, and the connecting shaft 34 are not parallel with each other and are with the different angle, the contact portion between the free end portion of the second link arm 40B and the internal surface 2*a* of the front door 2 moves along the arc curve on the internal surface 2*a* of the front door 2. As the front door 2 is closed, the trailing end (second engaging portion) of the second link arm 40B corresponds and contacts to the free end portion of the first link arm 40B. By this, the force for rotating the connecting shaft 34 applies.

When the front door 2 moves to the open position from the closed position, the boss 42*b* (second engaging portion) which is the engaging portion provided in the extension guiding member 42 engages with the first link arm 40A. This rotates the connecting shaft 34 to move the supporting member 27 to the second position from the first position. In other words, the extension guiding member 42 has the boss 42*b*, which engages with the connecting member 40A, when the front door 2 moves to the open position from the closed position to rotate the connecting member 40A.

In addition, the extension guiding member 42 is substantially extended to the outside of the apparatus main assembly 1A on the same surface with the supporting member 27 at the time of the open position of the front door 2, and, at the time of being the mounting of the cartridge P, it carries at least a part of the cartridge P and guides it to the mounting and demounting opening 24.

The extension guiding member 42 is accommodated inside of the front door 2 in the closed position of the front door 2.

A partition plate 42*a* which is a guiding portion is provided on the extension guiding member 42, and, it carries a part of cartridge P, and guides it to the inside or the outside of the apparatus main assembly 1A upon mounting and demounting the cartridge P. In addition, it provides a target of the insertion in the case that the user inserts the cartridge P.

In this embodiment, by closing front door 2, the extension guiding member 42 can be closed and in addition, the cartridge P can be positioned in the positioning portions 29 and 30 of the apparatus main assembly 1A. Therefore, the maintenance property of the cartridge and the operativity are better than the image forming apparatus of the embodiment 1 described above. In addition, in this embodiment, the coupling between the front door 2 and the connecting member 200 is established through the extension guiding member 42. Therefore, the connecting member 200 can be made small and the image forming apparatus 1 can be downsized. The other effects are the same as Embodiment 1.

Embodiment 3

Figure 16:
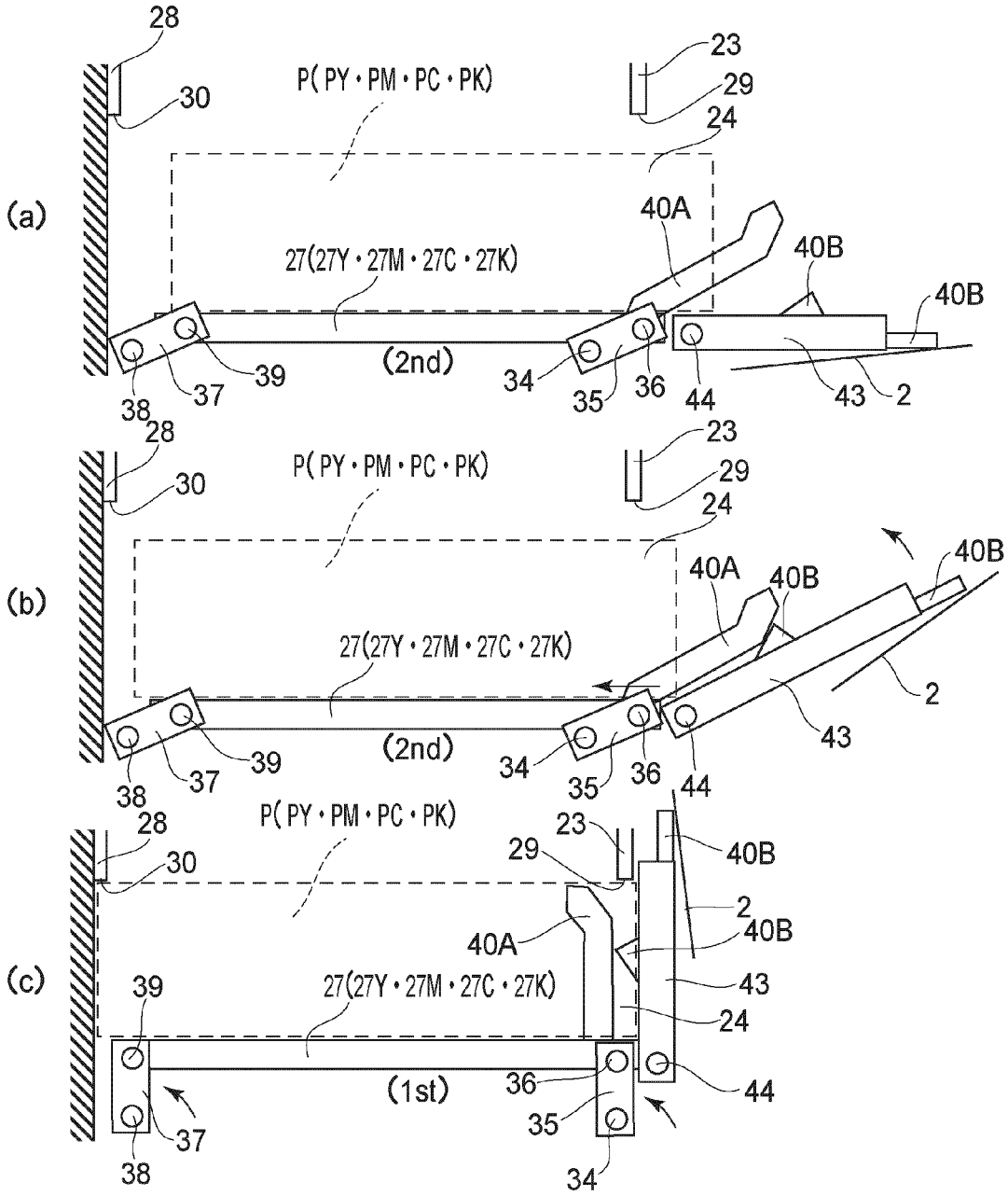
FIG. 16 is an illustration of an image forming apparatus of Embodiment 3.

FIG. 16 is an illustration of the image forming apparatus according to a third embodiment. In the description of this embodiment, the same reference numerals as in Embodiments 1 and 2 are assigned to the elements having the corresponding functions in this embodiment, and the detailed description thereof is omitted for simplicity. Designated by 43 is an inner door which is a supporting member disposed inside of the front door 2. This inner door 43 can make the opening and closing rotation relative to the opening 24 of the apparatus main assembly 1 about the rotation shaft 44 which is in parallel with the connecting shaft 34. In the course of the closing operation of the inner door 43, the first link arm 40A integrally rotated with the connecting shaft 34 engages with the second link arm 40B of the inner door 43, and, it rotates the supporting member connecting shaft 34 in interrelation with the closing operation of the inner door 43.

(a) of FIG. 16 shows the state where the cartridge P is not pushed to the predetermined position with respect to the longitudinal direction into the apparatus main assembly 1A, but remains on the inner door 43. When the front door 2 is shut, in this state, the cartridge P is pushed in by the inner door 43 to the predetermined position in the apparatus main assembly 1A. Thereafter, the connecting shaft 34 is rotated in interrelation with the closing operation of the continuing inner door 43, so that the supporting member 27 is behind and the rising movement is carried out to the first position ((b)-(c) of FIG. 16).

By this, even if the front door 2 is shut with the incomplete insertion to the inside of the apparatus main assembly 1A of the cartridge P, the positioning of the cartridge P is accomplished assuredly.

In the state shown in (a) of FIG. 16, the front door 2 and the inner door 43 are in the open positions, and, in this state, the first link arm 40A and the first second link arm 40B do not be in engagement with each other in the direction in which the inner door 43 is closed. The connecting member has the structure similar to Embodiment 2. More particularly, the connecting member 200 comprises the connecting shaft 34, the first arm member 35, and the first link arm 40A, as shown in FIG. 15 (*b*).

In (b) of FIG. 16, the front door 2 and the inner door 43 are the states in the course of the closing operation. In this state, the second link arm 40B is engaged with the connecting member 40A at an inclined surface, when the inner door 43 is closed to some extent. In the meantime, the cartridge P is pushed in by the inner door 43, and is moved into the apparatus main assembly 1A.

As shown in (c) of FIG. 16, the front door 2 and the inner door 43 are in the closed positions, and the second link arm 40B and the second first link arm 40A engage with each other, and thereafter, the connecting shaft 34 is rotated in interrelation with the closing operation of the inner door 43, and the supporting member 27 rises to the first position from the second position. By this, the cartridge P is positioned in the vertical direction.

In other words, the time difference is provided between the closing operation of the inner door 43 and the rising operation of the supporting member 27 in the image forming apparatus of the present embodiment.

Also in this embodiment, the inner door 43 is closed by closing the front door 2, and, the cartridge P can be positioned to the positioning portions 29 and 30 of the apparatus main assembly 1A. Therefore, the maintenance property of the cartridge and the operativity are better than the image forming apparatus of the embodiment 1 described above. In addition, in this embodiment, the coupling between the front door 2 and the connecting member 200 is established through the inner door 43. Accordingly, the connecting member 200 can be made small and the image forming apparatus 1 can be downsized. The other effects are the same as Embodiment 1.

Embodiment 4

Figure 17:
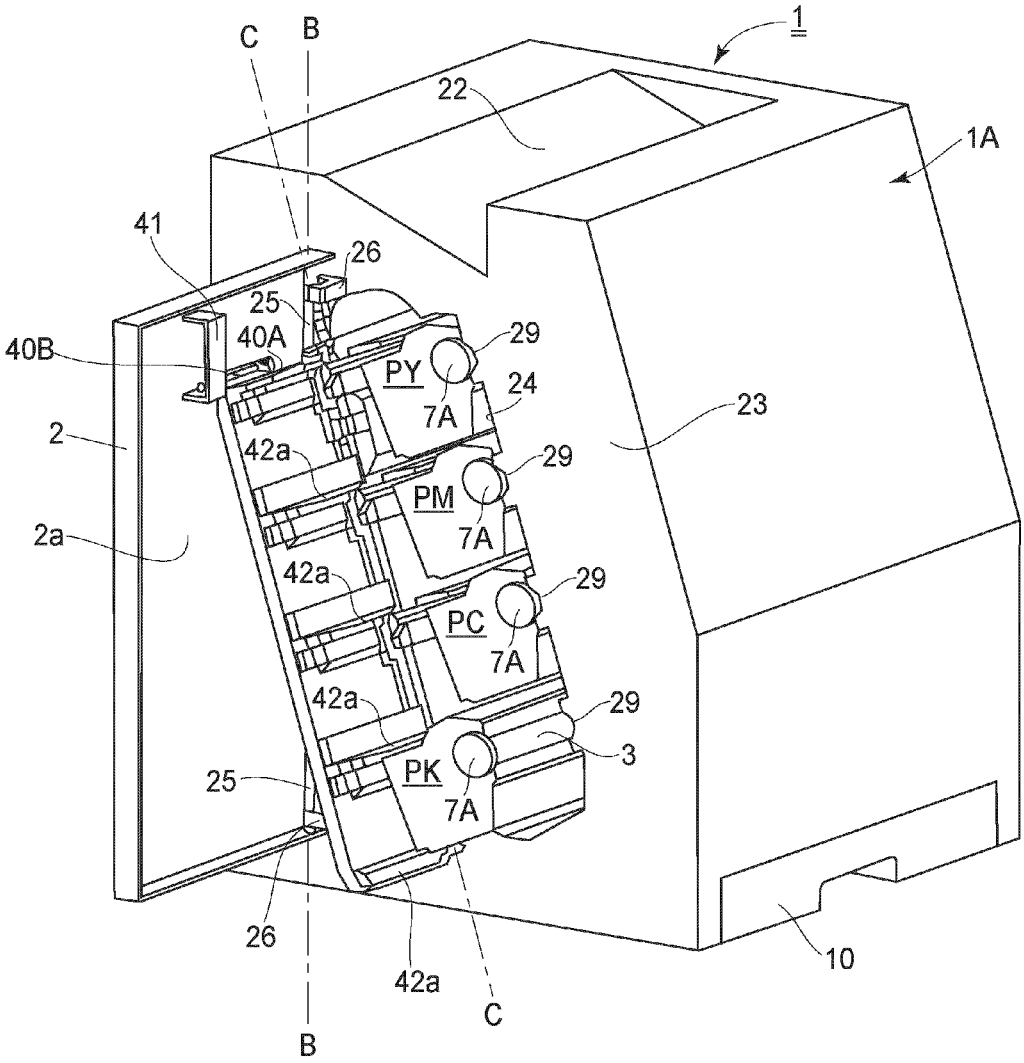
FIG. 17 is an outer appearance perspective view of an image forming apparatus of Embodiment 4 in which a front door is opened, wherein, a fourth process cartridge is pulled out halfway.

FIG. 17 is an illustration of an image forming apparatus according to the fourth embodiment. The door rotation shaft 25 of the front door 2 is extended in the vertical direction in this image forming apparatus 1. In the description of this embodiment, the same reference numerals as in Embodiments 1 or 2 are assigned to the elements having the corresponding functions in this embodiment, and the detailed description thereof is omitted for simplicity.

Although the four cartridges P are used in the image forming apparatus of the embodiments 1-4 described above, the present invention is applicable to the image forming apparatus which uses two or more cartridges.

In addition, the image bearing member may not be limited to the electrophotographic photosensitive member but may be electrostatic recording dielectrics and the magnetic recording member or the like.

In addition, the recording material feeding transfer belt for retaining and feeding the recording material S may be used in place of the intermediary transfer belt, wherein the toner image formed on the image bearing member of each cartridge is superimposedly transferred onto a surface of the recording material medium sequentially.

According to the embodiments of the present invention, the improvement of the operativity in the process cartridge exchange, the downsizing of the main assembly of the image forming apparatus, and the simplification can be accomplished.

While the invention has been described with reference to the structures disclosed herein, it is not confined to the details set forth, and this application is intended to cover such modification or changes as may come within the purposes of the improvements or the scope of the following claims.

This application claims priority from Japanese Patent Applications Nos. 129252/2007 and 077497/2008 filed May 15, 2007 and Mar. 25, 2008 which are hereby incorporated by reference.

What is claimed is:

1. An image forming apparatus for forming an image on a recording material, said image forming apparatus comprising:

an openable member provided in a main assembly of said apparatus and rotatable about a rotational axis thereof, said openable member being movable between an opening position for opening an opening provided in said main assembly of said apparatus and a closing position for closing said opening;

a belt for receiving an image or carrying the recording material;

a movable member movable between a first position for contacting a photosensitive drum to said belt and a second position for spacing said photosensitive drum from said belt, wherein a cartridge is mountable and demountable relative to said movable member at the second position; and a connecting member for moving said movable member in an interrelation with movement of said openable member, wherein said connecting member positions said movable member at the first position when said openable member takes the closing position, and said connecting member positions said movable member at the second position when said openable member takes the opening position, said connecting member having an axis crossing with the rotational axis of said openable member.

2. An apparatus according to claim 1, wherein said openable member includes an urging portion for urging said connecting member when said openable member moves from the opening position to the closing position, and an engaging portion for engaging with said connecting member when said openable member moves from the closing position to the opening position.

3. An apparatus according to claim 1, further comprising a link for movably connecting said movable member with said main assembly of said apparatus at a downstream side with respective to a direction in which the cartridge is mounted to said main assembly of said apparatus.

4. An apparatus according to claim 1, wherein the cartridge includes the photosensitive drum and is capable of being mounted to and dismounted from said movable member when said movable member takes the second position.

5. An apparatus according to claim 1, wherein the apparatus comprises a plurality of movable members.

6. An apparatus according to claim 5, wherein said movable members are disposed at different height levels.

7. An apparatus according to claim 5, wherein said connecting member is connected with said movable members.

8. An apparatus according to claim 5, wherein said connecting member includes a plurality of first connecting portions rotatably connected with respective movable members, and a second connecting portion for engagement with said openable member.

* * * * *